US009783900B2

(12) United States Patent
Grant

(10) Patent No.: US 9,783,900 B2
(45) Date of Patent: Oct. 10, 2017

(54) APPARATUS FOR USE IN ELECTROREFINING AND ELECTROWINNING

(75) Inventor: Duncan Grant, Bristol (GB)

(73) Assignee: OUTOTEC (FINLAND) OY, Espoo (FI)

( * ) Notice: Subject to any disclaimer, the term of this patent is extended or adjusted under 35 U.S.C. 154(b) by 55 days.

(21) Appl. No.: 13/814,521

(22) PCT Filed: Aug. 4, 2011

(86) PCT No.: PCT/GB2011/051478
§ 371 (c)(1),
(2), (4) Date: Feb. 6, 2013

(87) PCT Pub. No.: WO2012/020243
PCT Pub. Date: Feb. 16, 2012

(65) Prior Publication Data

US 2013/0126337 A1 May 23, 2013

(30) Foreign Application Priority Data

Aug. 11, 2010 (GB) ..... 1013429.4
Apr. 4, 2011 (GB) ..... 1105704.9

(51) Int. Cl.
*C25C 7/00* (2006.01)
*C25C 3/16* (2006.01)
(Continued)

(52) U.S. Cl.
CPC ..... *C25C 7/02* (2013.01); *C25C 3/16* (2013.01); *C25C 7/00* (2013.01); *C25C 7/06* (2013.01);
(Continued)

(58) Field of Classification Search
CPC .... C25C 7/02; C25C 7/00; C25C 7/06; C25C 1/06–1/12; C25D 17/10–17/12; C25B 9/04; C25B 9/045
(Continued)

(56) References Cited

U.S. PATENT DOCUMENTS 3,470,082 A * 9/1969 Reath ..... C25D 5/00 204/229.9
4,326,939 A 4/1982 Schmidt-Hatting
(Continued)

FOREIGN PATENT DOCUMENTS

CN 1896327 A 1/2007
JP 2537525 B2 9/1996
(Continued)

OTHER PUBLICATIONS

International Search Report (PCT/ISA/210) issued on Jan. 4, 2012, by the European Patent Office as the International Searching Authority for International Application No. PCT/GB2011/051478.
(Continued)

*Primary Examiner* — Brian W Cohen
(74) *Attorney, Agent, or Firm* — Buchanan, Ingersoll & Rooney PC

(57) ABSTRACT

An apparatus for use in the electro-production of metals, comprising a plurality of anodes and a plurality of cathodes in an interleaved configuration, wherein each anode and cathode pair forms a cell; a plurality of power supplies, each cell associated with one or more respective power supplies; and the power supplies are arranged to control a direct current in the one or more cells to a predetermined value.

20 Claims, 17 Drawing Sheets

(51) Int. Cl.
*C25C 7/02* (2006.01)
*C25D 17/00* (2006.01)
*C25C 7/06* (2006.01)

(52) U.S. Cl.
CPC ..... *C25D 17/00* (2013.01); *C25D 17/005* (2013.01); *C25D 17/007* (2013.01)

(58) Field of Classification Search
USPC ..... 205/82–84; 204/280, 291–293, 290.03
See application file for complete search history.

(56) References Cited

U.S. PATENT DOCUMENTS 4,786,384 A 11/1988 Gerhardt et al.
5,938,899 A * 8/1999 Forand ..... 204/259
6,146,515 A * 11/2000 Gutierrez et al. ..... 205/81
6,344,123 B1 * 2/2002 Bhatnagar ..... 205/96
6,398,939 B1 6/2002 Huens et al.
6,436,539 B1 8/2002 Goldstein et al.
6,758,951 B2 * 7/2004 Giaquinta ..... G01N 27/403 204/267
7,378,010 B2 * 5/2008 Stevens ..... C25C 1/12 205/574
7,837,851 B2 * 11/2010 Birang ..... C25D 21/12 205/123
2004/0238374 A1 12/2004 Tojo et al.
2005/0098442 A1 * 5/2005 Smedley et al. ..... 205/369
2005/0217999 A1 10/2005 You et al.
2005/0218001 A1 10/2005 You et al.
2008/0035473 A1 * 2/2008 Anastasijevic ..... C25C 1/12 204/242
2008/0179192 A1 * 7/2008 Arvin et al. ..... 205/238
2010/0006445 A1 * 1/2010 Tomantschger ..... 205/96
2010/0258435 A1 10/2010 Vidaurre Heiremans

FOREIGN PATENT DOCUMENTS

JP H10-195688 A 7/1998
JP 2007-529628 A 10/2007
WO WO 2009/016190 A2 2/2009

OTHER PUBLICATIONS

Office Action issued on Oct. 9, 2014, by the Australian Patent Office in corresponding Australian Application No. 2011288299. (4 pages).
Office Action (Notification of Reason for Refusal) issued on Jul. 7, 2015, by the Japanese Patent Office in corresponding Japanese Patent Application No. 2013-523664, and an English Translation of the Office Action. (7 pages).
Office Action issued Jun. 4, 2015, by the Mexican Patent Office in corresponding Mexican Patent Application No. MX/a/2013/001502, and an English Translation of the Office Action. (6 pages).
Office Action issued on Aug. 5, 2015, by the Chilean Patent Office in corresponding Chilean Patent Application No. 395-2013, and a partial English Translation of the Office Action. (11 pages).
Office Action issued on Dec. 4, 2015, by the State Intellectual Property of Office of the People's Republic of China in corresponding Chinese Patent Application No. 201180038818.7, and an English Translation of the Office Action. (15 pages).
Office Action (Patent Examination Report No. 1) issued on May 18, 2016, by the Australian Patent Office in corresponding Australian Patent Application No. 2015242937. (3 pages).

* cited by examiner $$I_C = \frac{V_{(A-C)}(R_1 + R_2)}{R_1 R_2}$$

$$\frac{I_1}{I_2} = \frac{R_2}{R_1}$$

APPARATUS FOR USE IN ELECTROREFINING AND ELECTROWINNING

FIELD OF THE INVENTION

The present invention relates to an apparatus for the electro-production of metals.

BACKGROUND OF THE INVENTION

In electrorefining (ER) and electrowinning (EW) electrodes are immersed in an electrolyte and an electric current is passed between them. The anode is made positive and the cathode made negative so that an electric current passes through the electrolyte from anode to cathode.

In electrorefining (ER), the metal anode is soluble. That is to say that the metal enters into the electrolyte under the influence of the potential between the anode and cathode. For example, in the electrorefining of copper, the anode is made of copper and the copper enters the electrolyte from the anode. The metal, now in the electrolyte, is transported through or by the electrolyte to the cathode where it is deposited. The cathode may be of the same metal as the metal that is being deposited or it may be of a different metal. For example, in the electrorefining of copper it was at one time common to employ a cathode made of copper. However, a stainless steel cathode is now commonly employed which quickly becomes coated with copper and which from then on essentially performs as a copper cathode. The deposited copper is mechanically removed from the stainless steel cathode and the cathode reused. The copper deposited on the cathode is highly pure. Impurities that were in the anode metal fall out as a solid as the anode is dissolved and may contain useful by-products, for example, gold. Besides copper, metals purified by ER include gold, silver, lead, cobalt, nickel, tin and other metals.

Electrowinning (EW) differs from electrorefining in that the metal sought is imported into the cells and is already contained within the electrolyte. In the example of copper, sulphuric acid is typically employed to dissolve copper from an oxide form of copper ore and the resulting liquor, after concentration, is imported into an electrowinning cell to have the copper extracted. An anode and cathode are immersed in the electrolyte and a current is passed between them, again with the anode being positive and the cathode being negative. In electrowinning, the anode is not soluble but is made of an inert material. Typically a lead alloy anode is used in the case of copper. The cathode may be of the same metal that is being extracted from the electrolyte or it may be of a different material. For example, in the case of copper, copper cathodes may be used although stainless steel cathodes are commonly employed which quickly become coated in copper. Under of the influence of the electric current, the metal to be won leaves the electrolyte solution and is deposited in a very pure form on the cathode. The electrolyte is changed by this process having given up a large proportion of its metal content. Besides copper, metals obtained by electrowinning include lead, gold, silver, zinc, chromium, cobalt, manganese, aluminium and other metals. For some metals, such as aluminium, the electrolyte is a molten material rather than an aqueous solution.

As an example of the voltages and current involved, in copper refining, the cell voltage is generally about 0.3V, the current density is about 300 Amps per square meter and the area of each electrode at present is about 1 meter squared.

These figures differ considerably for different metals but the invention applies to the refining and winning of all metals.

The electrical characteristics of ER and EW cells differ. In ER cells the over-potentials at the cathode and anode tend to cancel so that the cell has the characteristic of a resistance which in traditional systems is dominated by the electrolyte resistance. In EW cells the net over-potential is not zero and may well constitute the biggest part of the voltage between the anode and cathode. However, in addition there will be some voltage drop due to electrolyte resistance. These characteristics are illustrated in FIG. 13. FIG. 13 uses, by way of example, values approximately typical of those found in the ER and EW of copper.

FIG. 14 illustrates the origin of the ER line in FIG. 13 which shows the relationship between cathode current and anode-cathode voltage for ER. In ER the over-potential of the anode and cathode cancel so that the characteristics of one cathode and its adjacent anodes (consisting in this example of one cathode and two anodes separated by inter-electrode gaps IEG1 and IEG2) are approximately those of a 0.5 milliohm resistor. This resistor is effectively made up of two 1 m Ohm resistors in parallel, 1 m ohm being the approximate resistance of each of the two IEGs.

FIG. 15*a* shows an electrical circuit representing the ER situation. The total cathode current divides between the two sides of the cathodes in inverse proportion to the resistance of the inter-electrode gap and various other small resistances. The area of each side of the cathode plate is equal. So the current density on each side of the plates is inversely proportional to the resistance of the IEG (and other smaller contributions to resistance). The resistance of each IEG is roughly proportional to the width of the inter-electrode gap (IEG). If the IEGs are of different width, the total current at each side of the cathode (and hence the current density on each side) will be different.

FIG. 15*b* shows an electrical circuit representing the EW situation. In FIG. 13 the line marked EW shows the relationship between cathode current and anode-cathode voltage for EW. The arrangement of electrodes is the same as shown in FIG. 14. In FIG. 13 the line for EW is displaced upwards by an amount equal to the net over-potential in a cell which for the EW of copper is about 1.5V. For other metals it can be much larger, even above 3.0V. Hence the total voltage across a cell is equal to the sum of the net over-potential and the voltage due to the passage of current through the electrolyte resistance (as well as some other minor contributions to resistance). The approximate electrical equivalent circuit for EW is shown in FIG. 15*b*. As before with ER, in EW any inequality in the resistance of the electrolyte in the IEG on each side of the cathode can give rise to an inequality in current density on each side of the cathode unless each IEG is individually driven by a controlled current supply. Similarly, any variation in the net over-potential in each of the IEGs will give rise to unequal current density in the IEGs unless each IEG is individually supplied.

Terminology

In ER and EW the starting point is an anode juxtaposed to a cathode in an electrolyte contained in a tank. But many cathode plates and many anode plates may be used, interleaved, with all the anode plates connected in parallel and all the cathode plates connected in parallel contained within a single tank of electrolyte. Electrically this still looks like a single cell and in the industry it is therefore commonly called a cell.

In the ER and EW industry, "cell" is almost universally used to mean a tank filled with anodes and cathodes in parallel.

In the ER and EW industry, "tank" can mean the same as "cell", above, or it can mean the vessel alone, depending on the context.

So there is potential for confusion if the number of plates in parallel is not alluded to. The present invention is applicable to a cell consisting of one cathode and one anode and one inter-electrode gap (IEG). Hence at the most basic level the word "cell" can be synonymous with a single IEG. In the following description "cell" is used to mean cooperating electrodes separated by an inter-electrode gap. If both sides of the cathode are to be used for metal deposition, two anodes are required giving two IEGs. For further increase in cathode surface area, more anodes and cathodes must be added and hence more IEGs are added. There are twice as many IEGs as cathodes Referring first to FIG. 1, a basic cell generally designated 24 is shown consisting of one cathode 1 and one anode 2 and one inter-electrode gap (IEG) 3. The cathode 1 and the anode 2 are immersed in an electrolyte 4 contained in a tank 5.

FIG. 2 shows one cathode 1 and two anodes 2 connected in parallel, the whole arrangement creating two IEGs 3.

In tank houses "tanks" are connected in series. A typical ER tank house might therefore require an electrical supply of the order of 36,000 Amps at 250 Volts.

Problems with the Prior Art Processes

In a typical process a number of anode and cathode plates are interleaved and supplied in parallel from positive and negative bus bars so that each anode-cathode pair of plates is effectively supplied from a common voltage source. This results in a spread of current density in the cells due to differences in the resistance of the cells. These differences arise from a spread in the values of, amongst other things, plate separation, plate internal resistance, resistance of the contact between the plates and the bus bars, alignment and flatness of the plates, state of the plates and electrolyte condition.

The efficiency and speed of the electro-production process can be adversely affected if the current density in the cell is not held within certain limits. The quality of the metal deposited can also be affected by the current density.

Additionally a poorly controlled current density can encourage the growth of metal spikes on the plates which can lead to short circuits between the plates.

Many cells are usually connected in parallel by the parallel connection of all anodes in a tank and the parallel connection of all cathodes in a tank but series-parallel connection or series connection is also possible. Hence the current density in a given cell is affected by the condition of other cells and therefore may depart from the ideal.

Electrodes have to be made and positioned to a high accuracy to ensure uniformity of cell characteristics.

The current density that is ideal for one cell may not be ideal for another cell.

The voltage that is ideal for one cell may not be ideal for other cells.

Electrolyte concentration may vary from time to time changing the characteristic of a given cell dynamically during the electrowinning or electrorefining process.

The current to the cells is conveyed over substantial distances at a high current value. Since losses in a conductor are proportional to the square of the current this process is wasteful of energy.

The voltage applied to each cell can be poorly regulated, particularly when supplied through long, high-current bus bars which are loaded with cells the condition of which is variable.

Contact resistance between the plates and the bus bars can vary substantially resulting in poor control of current through the plates and current density on the plates In some systems, for example in copper refining, a steel cathode is sometimes used with the resulting copper deposition being stripped off and the plate reused. The steel plates can deteriorate with time and use and therefore experience changes in their internal resistance giving rise to poor control of current through the plates and poor current density control on the plates.

The anode thickness and characteristics change during a crop (i.e. during the electro-production process) and between crops making it difficult to obtain the ideal current density during any particular crop.

SUMMARY OF INVENTION

According to a first aspect of the invention there is provided an apparatus for use in the electro-production of metals, comprising a plurality of anodes and a plurality of cathodes in an interleaved configuration, wherein each anode and cathode pair forms a cell; a plurality of power supplies, each cell associated with one or more respective power supplies; and the power supplies are arranged to control a direct current in the one or more cells to a predetermined value.

According to a second aspect of the invention there is provided an apparatus for use in the electroproduction or electrorefining, comprising: first and second electrodes; at least one bus bar; at least one power supply; wherein a power supply is associated with an electrode and is arranged to regulate a current supply from a bus bar to the electrode.

According to a third aspect of the invention there is provided an apparatus for electroproduction or electrorefining of material comprising: an electrode comprising: a first conducting layer and a second conducting layer; wherein the first conducting layer and the second conducting layer are separated by an electrically insulating layer.

According to a fourth aspect of the present invention there is provided an apparatus for electro-production of materials comprising first and second electrodes and actuators for controlling a separation there between as a function of at least one of: evolution of current-voltage characteristic between the first and second electrodes; electrode condition; time.

According to a fifth aspect of the present invention there is provided an electro-production apparatus where at least some connectors between power supplies, hanger bars, and electrodes comprise contacts which press against a cooperating conductive surface.

According to a sixth aspect of the present invention there is provided an electro-production apparatus comprising:

a plurality of electrodes;

current sensors associated with at least some of the electrodes, and output or data-processing circuits for outputting or processing the current measurements.

DESCRIPTION OF THE DRAWINGS

Embodiments of the invention will now be described by way of example with reference to the accompanying drawings, in which.

DESCRIPTION OF PREFERRED EMBODIMENTS OF THE INVENTION

Figure 1:
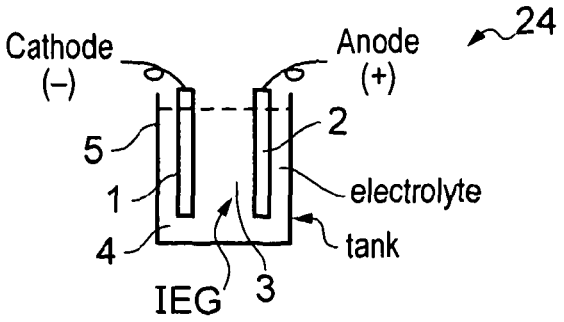
FIG. 1 is an illustration of a basic cell or IEG.
Figure 2:
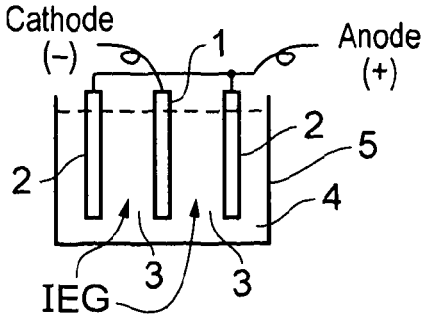
FIG. 2 is a side view of two anodes and one cathode creating two IEGs.
Figure 3:
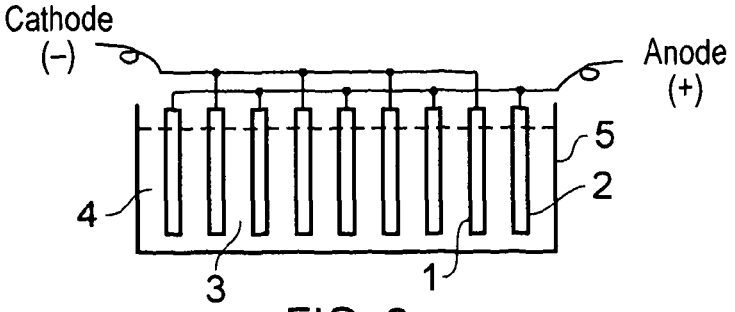
FIG. 3 is a side view of multiple anodes in parallel and multiple cathodes in parallel.

Referring to FIG. 3, the illustration shows a tank arrangement that is common in prior art electrowinning and electrorefining plants. Multiple cathodes 1 are connected in parallel and multiple anodes 2 are connected in parallel to increase the total cathode surface area. There are twice as many IEGs as cathodes.

Figure 4:
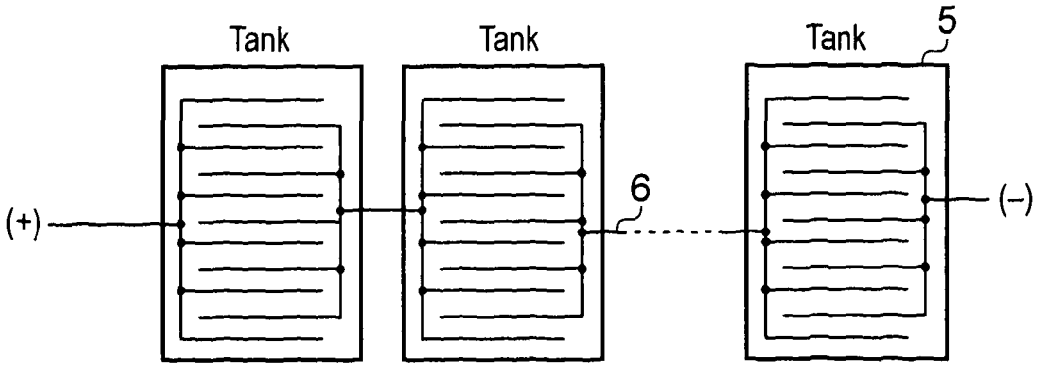
FIG. 4 is a top view of a plurality of tanks in series.

FIG. 4 shows a prior art system having a multiplicity of tanks 5 connected in series. An interconnector 6 connects the tanks and is in practice not a single cable but multiple connections are made via equaliser bars which ensure connection is made between tanks at multiple points.

Any arrangement which feeds a certain voltage to the cathode (with respect to its adjacent anodes) or current to the cathode will have difficulty maintaining equal current density on each side of the cathode. Anodes are typically spaced a fixed distance apart (typically 10 cm). Efforts have been made over the years to maintain cathode plates in a flat condition and to locate them accurately within the tank. Nevertheless 2.5 mm of accuracy on spacing and 2.5 mm of flatness deviation are considered good achievements. It will be readily appreciated that a 5 mm error in an interelectrode gap of 50 mm could lead to approximately a 10% error in current density on either side of the cathode. Also, anode thickness will vary during and between cropping adding another opportunity for uneven IEG widths to arise. The inventor has realised that to achieve accurate current density on both sides of the cathode plate, it is advantageous to control the current in the IEG or to individual cathodes. The invention described herein offers the control of current in either the cathode or the IEG according to the version the user deems most appropriate, with most accurate control of current density being obtained when the IEG current is controlled.

The inventor has realised that the efficiency of the electrorefining or electrowinning process can be improved by individual cell control. In the conventional process in which each cell current is not individually controlled, one reason plate separation has to be large is to keep current density largely unaffected by errors in the plate separation or by problems with plate flatness. If the current in each cell is individually controlled, the current density can be made insensitive to plate separation and plate distortion and therefore the plates can be placed closer together. This in turn reduces the cell voltage and hence the power consumed by the cell for the production of a given amount of metal.

In addition, the efficiency of each cell (in terms of metal produced per kWhr of energy used) is sensitive to current density in the cell. Hence the ability to hold the current density at the desired value enables the cell to work at optimum efficiency. Further, the current density needed for optimum efficiency may vary during the refining or winning process. The invention permits the target current density to be altered dynamically according to cell conditions which may be sensed from the cell voltage or other measured parameters (e.g. electrolyte strength or temperature).

A power conversion system (which can also be regarded as a power supply) is therefore provided for electrorefining or electrowinning cells in which power is taken from a relatively high voltage supply (ac or dc) and converted at the cell location to low voltage dc to supply a single cell so that in a plant of many cells each cell will have its own power converter. The power converter is adjacent to or part of the cell and is operated as a current source, thereby ensuring control of the current density for each cell. The current density can be modified locally according to the condition of the cell or the cell condition can be reported to a central control system which calculates the optimum current for that cell and commands the power converter to deliver the desired current. As an alternative the power converter may feed current to a cathode electrode with the anodes on each side of the cathode connected together and to the converter. It will however be appreciated that in this arrangement there is no control over how the cathode current divides into the two individual cells (one on each side of the cathode), but this arrangement is more suitable for retrofitting to existing ER and EW tanks In the prior art when tanks are harvested it is necessary to remove them from the series circuit of tanks This involves the provision of expensive contactors which remove the tank from the circuit and provide a by-pass connection through which current can continue to circulate. A benefit of the present invention is that where each cathode or IEG is powered by a separate power supply it is only necessary to turn off these power supplies to permit harvesting or servicing of the cells to proceed.

Figure 5:
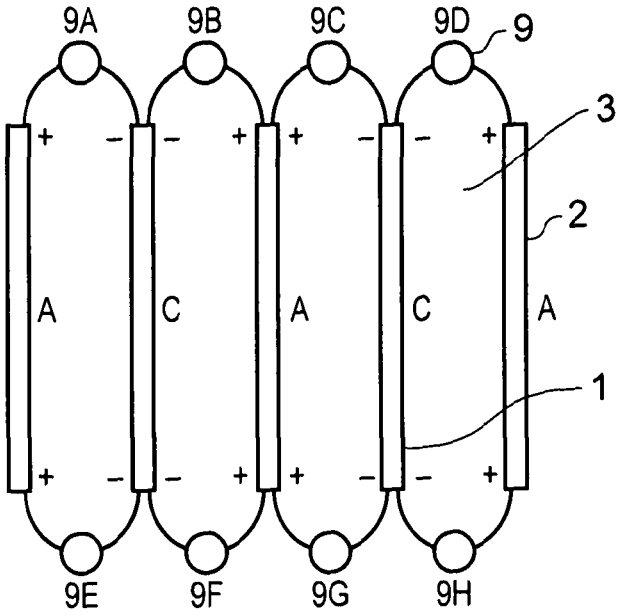
FIG. 5 is an illustration of a converter layout constituting an embodiment of the present invention where IEG voltages are varied.

FIG. 5 shows how the electrodes may be supplied when the interelectrode gaps (IEGs) are driven by power converters 9. The alternating cathode plates 1 and anode plates 2 are marked A C A C A and are viewed end on (i.e. from above in a vertical plate system). The power converters 9 are represented by circles. The plates (and hence the interelectrode gaps 3) may be supplied from both edges (corners) using all the converters shown (9A to 9H inclusive). Alternatively, the plates may be supplied from one edge (corner) by using only converters 9A to 9D inclusive. Alternatively the plates may be supplied from both edges (corners) but with the power converters only acting on alternate interelectrode gaps (converters 9A, 9C, 9F and 9H being active). Considerations such as reducing converter count, optimal converter power and obtaining even current distribution determine which converter distribution is employed.

Figure 6:
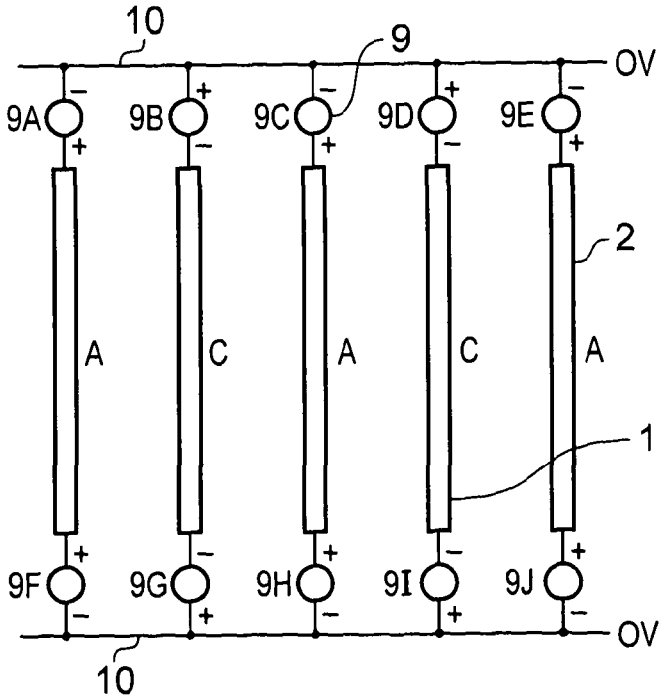
FIG. 6 is an illustration of a converter constituting an embodiment of the invention layout where the electrode voltages are controlled.

In an alternative embodiment the electrodes 1, 2 may be driven (rather than the interelectrode gaps) as is shown in FIG. 6. This configuration is particularly (but not exclusively) applicable when the converter is a buck regulator inserted between the conventional bus-bar distribution system and the plate, the configuration of which will be explained in more detail below. The alternating anode plates 2 and cathode plates 1 are marked A C A C A. The power converters 9 are represented by circles. The converters 9A to 9J have one terminal connected to a plate and the other connected to a common bus 10 to which the voltage 0V has been assigned. The plates can be supplied from one side using converters 9A to 9E inclusive or from both sides when converters 9A to 9J inclusive are employed. Typically all converters would produce a similar IEG voltage so that if for instance the cell voltage was 0.4V, the converters attached to anodes would supply half the cell voltage (+0.2V) and the converters supply the cathodes would also supply half the cell voltage (−0.2V). There would be some current flowing through the 0V common bus but mostly this would be locally circulating current so that its magnitude should not exceed the cell current or at most twice the cell current. Alternatively the converters may be employed in interleaved fashion to reduce the converter count. For instance converters 9A, 9C, 9E, 9G and 9I could be employed only. Furthermore, it is possible not to supply some plates directly with a converter. For example, the cathode plates could be connected directly to the 0V bus bars. The converters 9A, 9C, 9E, 9F, 9H and 9J would supply the anode plates with current at full cell voltage (0.4V in the example above). Again, the number of converters employed could be reduced by operating converters 9A, 9C, 9E only or 9A, 9H, 9E only.

Alternatively, the anodes could all be connected to a common bus. Then converters 9B, 9D, 9G and 9I would supply the cathodes (with −0.4V in the example). The number of converters could be halved by using only converters 9B and 9D or only converters 9G and 91. Alternatively, the converters could be staggered between different sides of the tank. It will be recognised that where, as in this example, all the anodes are common and the cathodes only are driven that the current in the cells as defined by a pair of electrodes and an associated interelectrode gap is not under individual control.

The converter circuits described herein represent likely candidates for the type of circuit to be used. It will be understood that there are a variety of methods for converting dc to dc or ac to dc which may be applied in the systems described. The examples given herein are double-ended converters but single-ended converters may be used. When very high switching frequencies are used in the converters in order to increase the power density of the converters, it may be convenient to employ resonant or quasi-resonant circuits. The rectification process illustrated in the circuits herein employs synchronous rectification. However, if the power loss entailed was not a significant consideration, simple diode rectifiers (Schottky or PN) could be employed.

Advantageously, the power conversion process uses high-frequency switched-mode technology which provides a converter which can be small, lightweight, efficient and highly controllable.

Figure 7A:
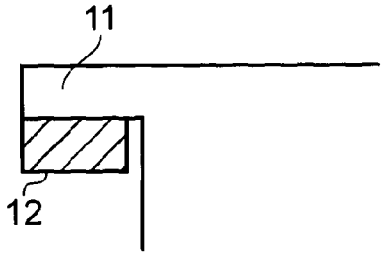
FIGS. 7*a* to 7*c* are side views of an electrode illustrating how converters or regulators can be inserted between plates and bus bars.
Figure 7B:
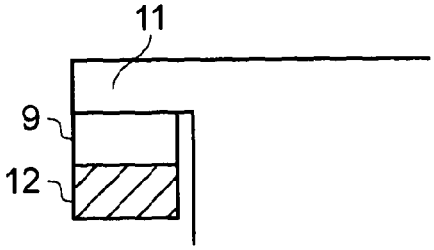

FIG. 7 shows how the converters of FIG. 6 may be incorporated in the plate configurations conventionally employed. As FIG. 7*a* shows in a traditional system how electrode projections, herein described as lugs 11 rest on bus bars 12 to make a connection between the electrode plates and the bus bars. As FIG. 7*b* shows, a converter or regulator circuit 9 can be inserted between the lug 11 and the bus bar 12 to regulate current flow between the lug 11 and the bus bar 12.

Figure 7C:
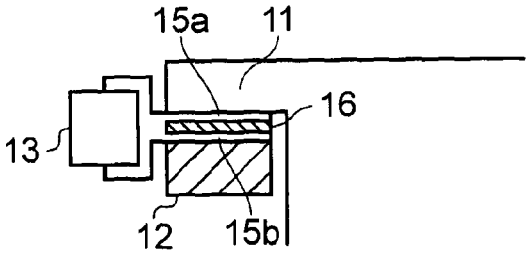

Alternatively, as is shown in FIG. 7*c*, a powered unit 13 (i.e. one optionally receiving a further power supply) may be inserted between the lug 11 and the bus bar 12. This unit can increase the voltage available to the electrode connected to lug 11 by adding to the voltage of the bus bars 12 (subtracting from the voltage of the bus bar 12 if it is a negative bus bar). Connections are made via contact plates 15*a* and 15*b* separated from each other by an insulating layer 16. Typically the lug 11 is part of a hanger bar supporting an electrode plate when the electrode is a cathode.

Figure 8:
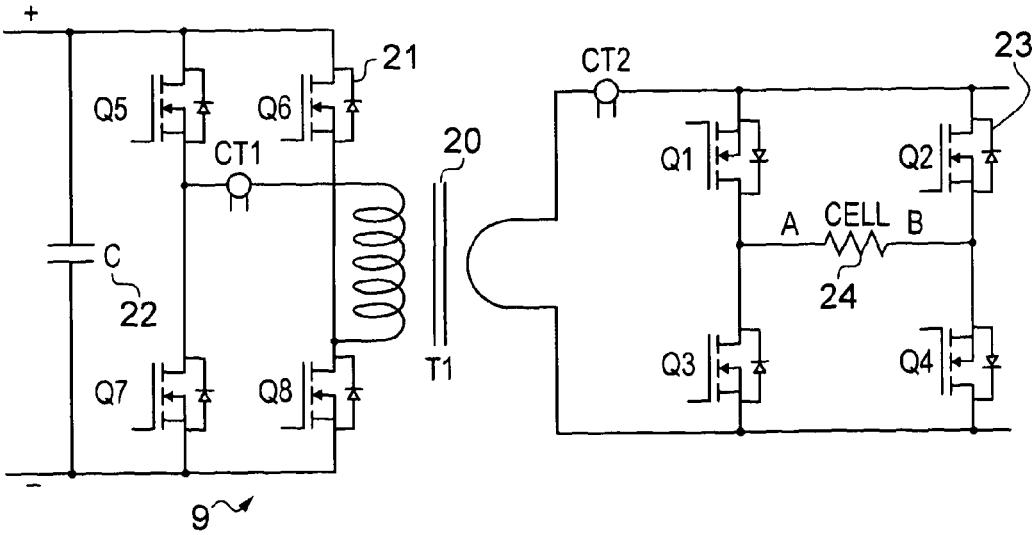
FIG. 8 is a circuit diagram of a converter with bridge rectifier in the output.

FIG. 8 shows how the converter power supply circuit 9 may be implemented. A transformer 20 is used because of the high voltage ratio which will typically exist between the converter input voltage and the converter output voltage. The use of a transformer permits power semiconductor switches to operate with a duty cycle which gives a good form factor to the current in these switches thereby minimising power loss. The primary of the transformer 20 is a full-bridge inverter but it will be understood that a half-bridge inverter may be used. The transformer operates at a high frequency to reduce the size and cost of the transformer and any other passive components employed (e.g. capacitors). This high frequency may be from 20 kHz upward. It will be understood that while the switching devices 21 (Q5 to Q8) shown in the primary side are power MOSFETS, other semiconductor switches such as IGBTs or BJTs can also be applied here. A capacitor 22 is provided to circulate high-frequency switching currents. The output from the secondary winding is rectified in a full-bridge, full-wave rectifier to give dc for use in the cell. The body-drain diodes of the power MOSFETs 23 (Q1 to Q4) could be used to rectify the ac output of the secondary winding of the transformer so that the end A of the cell 24 was positive with respect to end B. However the forward voltage drop across these diodes would result in significant power loss in the MOSFETs. The MOSFETS are therefore advantageously operated as synchronous rectifiers. Their channels are turned on when the body-drain diodes are expected to be conducting (i.e. the MOSFETS are operated in synchronism with the switching devices in the primary side of the converter). The Rds(on) of each MOSFET can effectively be made as small as necessary either by choosing a suitably rated MOSFET or by connecting MOSFETs in parallel effectively to form one MOSFET switch. By this means power loss in the MOSFETS 23 can be kept to a reasonable level. For instance, if the converter outputs 300A at 0.4V dc, MOSFET switches with an Rds(on) of 0.1 mOhm would create a voltage drop across them of 30 mV. With two MOSFET switches in the current path, the total voltage drop would be 60 mV, or 15% of the output voltage. N-channel MOSFETS are generally preferred because for a given Rds(on) the price is usually lower but it will be understood that N and P channel MOSFETS can be used in any combination if required.

Where a number of MOSFETs are connected in parallel to create a device with a lower Rds(on) than that possessed by a single device, at the very low magnitudes of Rds(on) available in a single silicon die, it will be advantageous to configure these dice (dies) not as individually packaged devices but as naked dice paralleled internally in a single package. For instance, the Rds(on) of a 0.8 mOhm MOSFET may be made up of 0.3 mOhm of silicon resistance and 0.5 mOhm of package resistance when packaged individually. In such a case it is clearly advantageous to parallel the silicon dice within a single package since interconnections between dice can be made with less resistance than if the drain and source connections have to be brought out of the package of a single-die device and into the package of another single-die device.

When the output voltage from the secondary winding of the transformer is below 0.7V peak, each of the MOSFET switches 23 may be regarded as a bilateral switch (that is, capable of blocking in either direction and capable of conducting in either direction). Hence the secondary bridge can be switched so as to produce a positive output at B relative to A on both half cycles of the transformer secondary voltage waveform (i.e. the cell voltage and current flow are reversed). A temporary reversal of cell polarity has been shown to have a beneficial effect in some circumstances (e.g. restoration of cell efficiency or reduction of metal spikes on the plates). In these circumstances it will be understood that the MOSFETS can be connected either way round in any part of the bridge for convenience of control. If reversal is required at higher voltages (above about 0.7V) the switches Q1, Q2, Q3 and Q4 can be replaced by a pair of anti-series MOSFETs.

Capacitance (not shown) may be added across the cell 24 to smooth the voltage waveform at the cell. If there is significant inductance in the cell and associated wiring, a circulating current path can be provided by turning on a pair of transistors (for example Q1 and Q2) in order to control circulating currents.

Current transformers CT1 and CT2 may be located on the primary and secondary side respectively to derive a signal which is related to the dc output current from the rectifier bridge. CT1 measures a current which contains the primary magnetising current and the reflected secondary load current. This measurement may be accurate enough for the purpose of controlling the dc output current of the converter. Of course the dc output current may be measured directly at the output using some form of dc current transducer (e.g. Hall effect).

The transformer employed preferably has low leakage inductance since large values of current are provided by the secondary winding. A planar transformer with interleaved primary and secondary windings can provide the low leakage inductance required as well as having a conveniently low profile and being suitable for conduction cooling. Where the synchronous rectifier MOSFET switches consist of a number of MOSFETS in parallel, the option exists to employ a number of secondary windings, one per MOSFET, so that the rectified currents are only combined after each of the synchronous rectifier MOSFETs. Torroidal-cored transformers are also known to provide low leakage inductance.

Optionally, the power conversion circuit is suitably configured so that it can be made reversible. That is, the voltage and current flow may be reversed. A period of reverse current flow has in some processes been found to be beneficial in promoting higher efficiency when forward current flow is restored. The employment of a converter local to the cells for each cell enables this technique to be used in the most advantageous manner.

Output current and output voltage are controlled by employing Pulse Width Modulation (PWM) in the well known manner. This PWM control may be applied at the primary side or at the secondary side or on both sides. Other forms of control, other than PWM are available but all depend on switching the MOSFETs on and off in a manner which achieves the desired result. PWM is used here as shorthand for "controlled in one of the manners typically employed in switched-mode converters".

Figure 9:
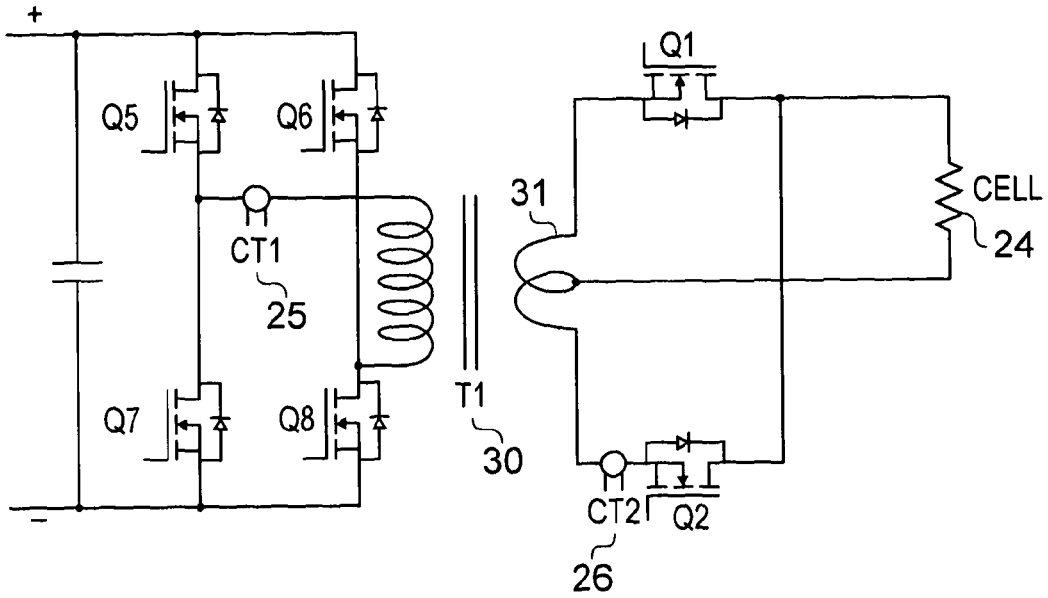
FIG. 9 is a circuit diagram of a converter with a centre-tapped transformer secondary winding.

FIG. 9 shows a converter circuit in which a transformer 30 with a centre-tapped secondary winding 31 is used. CT1 and CT2 indicate suitable locations for the current transformers for the purposes of obtaining the dc current output feedback signal. Secondary side transistors Q1 and Q2 are operated as synchronous rectifiers as before. The ability to provide reverse current flow in the cell is limited to output voltages of about 0.3V. If reversibility is required at a higher voltage, Q1 and Q2 can be replaced by a pairs of anti-series MOSFETs which are then be made to behave as bilateral switches.

The power converters are rated according to the size of plates being driven. The cells can be made larger or smaller than is usual to take advantage of the technology described herein. Separation distances between electrodes need not be the values conventionally used. Indeed, one of the advantages of the present invention is that plate separation can be reduced because of more accurate and faster control of the current in the cell as well as the potential to adapt the cell current density to suit prevailing conditions. A smaller plate separation leads to a reduction in cell resistance resulting in less power loss in the cell. Plate configuration options, including variations in plate separation are explained in more detail below.

Where it is advantageous to do so, the power converters can be continually or transiently operated on some other control principle (e.g. operate as a voltage source).

Optionally, the power converters and their control systems may be made submersible (in the electrolyte). Contact with the plates may be at the bottom of the plates when gravity and the weight of the plates can produce an electrical contact between the plates and contact strips (probably of a non-corroding, non-consumable material) on the bottom of the tank.

In the simplest of control (optimisation) systems, the converter may be set to produce a current of a fixed value. The magnitude of the current delivered to the cell can be sensed directly by a dc current sensing method if required but because the power conversion process takes place close to and on behalf of a single cell, the current signal can conveniently be sensed within the power conversion process (for example by the use of an ac current transformer at some convenient point in the switched-mode power conversion circuit as discharged hereinbefore with reference to FIGS. 8 and 9.

In a more sophisticated control system, the control system may adapt the current density to the state of the cell. The state of the cell can be measured using a number of variables—for instance the cell voltage. Other parameters may be monitored, for instance electrolyte temperature, electrolyte concentration, and optical evidence of spike growth. Other characteristics may also be used to monitor cell condition. For instance the cell current may be turned off briefly and its recovery when a certain voltage or current is applied may be observed.

In a traditional ER or EW plant a wide spread of current density on cathode sides can be expected. The present invention may have the capability to hold the current in the IEGs (or optionally the total current to a cathode) to an accuracy dependent only on the accuracy of the current sensor or sensors employed to measure the current. An accuracy of 0.1% is achievable with dc or ac current sensors. Lower cost current sensors can achieve an accuracy of 1%. Hence the standard deviation in current densities between the many cells in an ER or EW system will be far smaller than that achieved by current practice leading to fewer shorts and higher quality copper.

In general there are two types of current measurement—DC and AC. Both may be used with the invention.

As described hereinbefore, AC current measurement can be carried out quite economically by using a current transformer. The anodes, cathodes and IEGs in the invention are fed with DC. But when these DC currents are generated or regulated using switched-mode technology there are AC current signals available which may be measured using low cost AC transducers based on the well known AC current transformer method. Where multiple current paths exist in the converter or regulator it may only be necessary to measure accurately the absolute value of the contribution of one of those paths. The current measurement arrangement in the other paths is only then required to ensure that the current in all the paths is equal, not to make an absolute measurement. The total current measurement can be obtained by multiplying the one absolute measurement by the number of paths.

Other current measuring techniques are possible.

The most basic method of obtaining a DC current measurement is obtained by inserting a resistor of known value in the current path. However, when the voltage of the supply is low (as in this case) and the current is large (as in this case) a resistor of very low resistance is required. Such resistors tend to be difficult to make and expensive to buy. The value of the resistance is also temperature dependent which can lead to measurement inaccuracy if the current passing through the measurement resistor heats it significantly.

DC current measurement is also possible by employing a magnetic circuit which encircles the conductor. A Hall effect sensor is inserted in a slot in the magnetic path. The current is then measured by measuring the flux in the magnetic circuit using either an open loop method or the flux-null method. This arrangement is practical but may be bulky and expensive.

Figure 12:
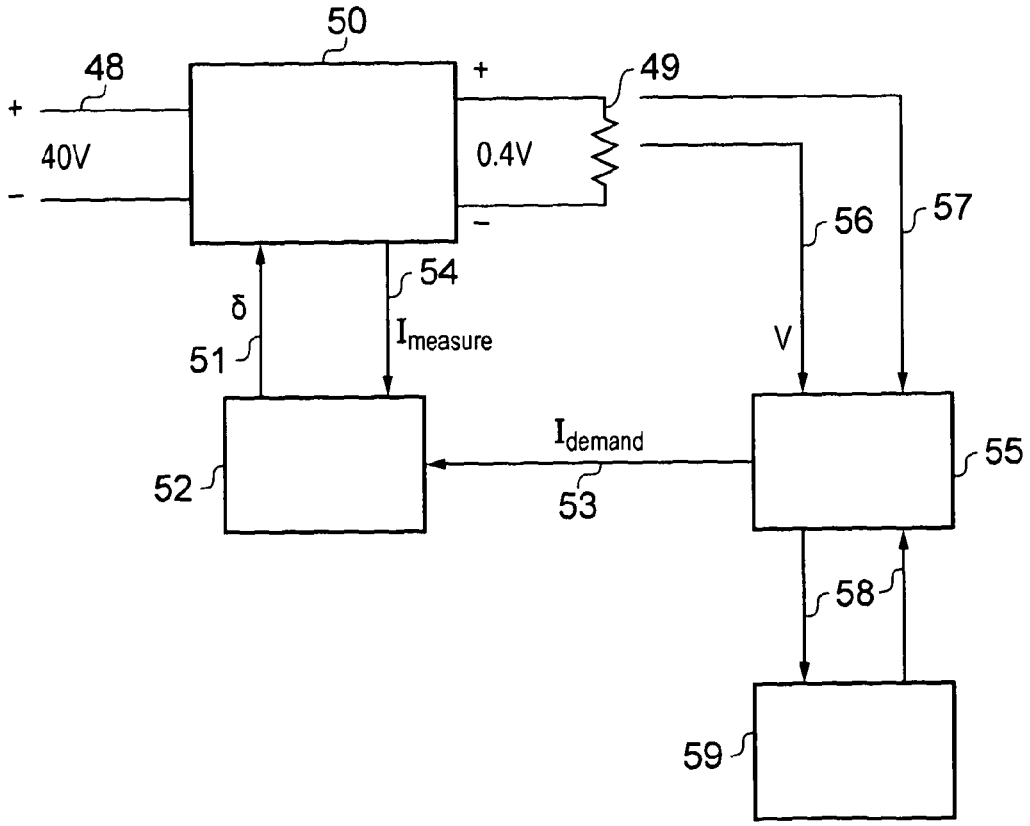
FIG. 12 is a schematic drawing of a cell control system in accordance with an embodiment of the invention.
Figure 13:
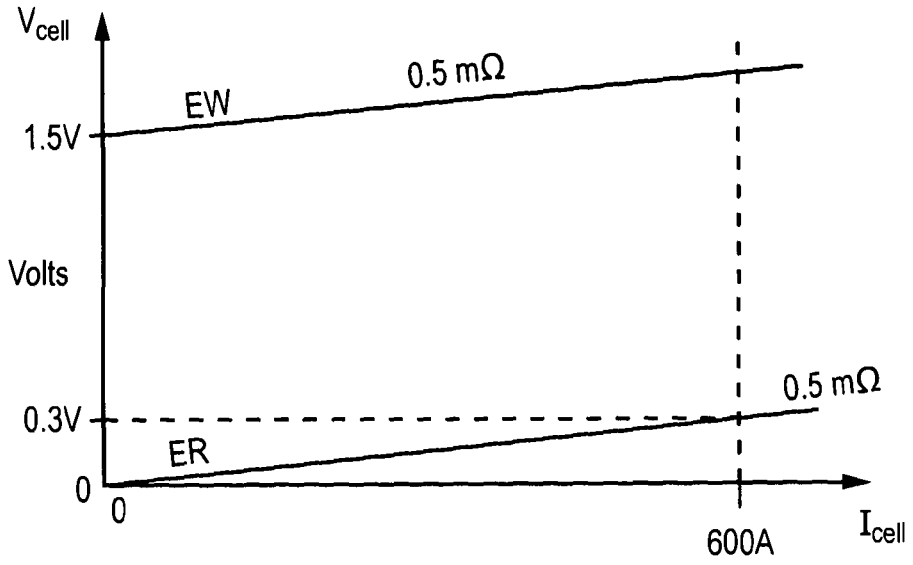
FIG. 13 is a graphical illustration of the current versus voltage characteristics of ER and EW cells.
Figure 14:
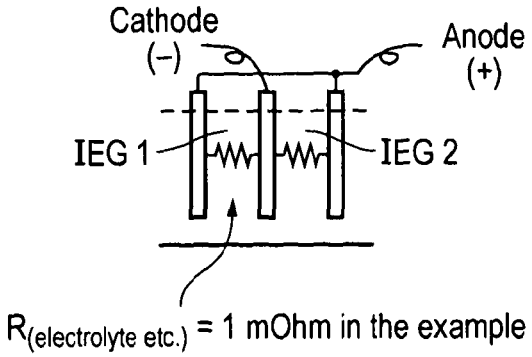
FIG. 14 is a side view as illustrated in FIG. 2, further showing the electrical origin of ER cell characteristics.
Figure 15A:
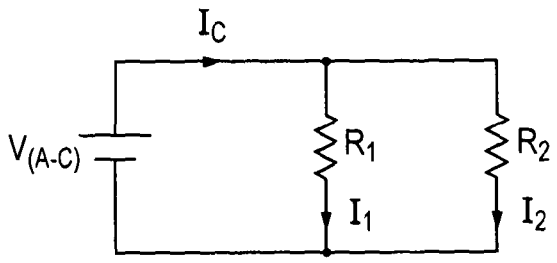
FIG. 15*a* shows an electrical circuit representing ER cells.
Figure 15B:
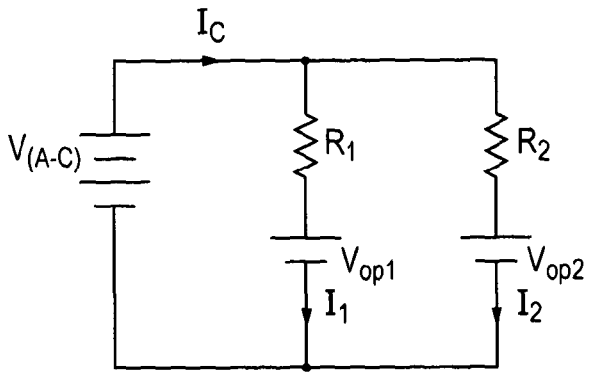
FIG. 15*b* shows an electrical circuit representing EW cells.

FIG. 12 illustrates schematically a control system. The cell power converter 50 is supplied from a 48V dc supply 48 and provides a current-controlled output to an electrorefining or electrowinning cell 49. The required current level is achieved by use of a suitable switching duty cycle in the converter 50 controlled by a PWM duty cycle signal 51. This signal is derived in a current control loop 52 by comparing a current demand signal 53 with a current measurement signal 54 representing a measured current. The current measurement signal 54 is derived from current detectors in the converter 52 or at its output. The current demand signal 53 can be preset or it can be derived from a cell controller 55 which measures cell voltage 56 and possibly derives information from other relevant sources 57 (e.g. sensors in the cell and in the vicinity) in order to adapt the current demand to changing circumstances. The cell controller may also have two-way communication 58 with a central control facility for the purposes of downloading a crop session history, or reporting cell condition and operating parameters at any time and for receiving revised instructions as to how the cell should operate. The use of a power converter for each cell simultaneously provides a current measuring facility for that cell. As noted before variables such as cell voltage can also be measured as part of the control process and are therefore available for analysing and reporting on cell condition. Cell condition can be measured by the converter being commanded locally or remotely to perform a task (such as a step change in current or adding an AC component to the DC converter output current) to enable cell condition to be observed. Cell performance can be enhanced by commanding (locally or remotely) the cell to perform performance enhancing manoeuvres such as a brief current reversal.

Where the converter incorporates the ability to change current direction an interval of current reversal may yield signals which give a good indication of cell condition. Such a measure may need to be applied simultaneously to two the cells associated with a single cathode.

A visual or audible warning system may be incorporated into several or every converter and its control system to warn of problems. A display on a converter can inform a passing operator of the associated cell condition or performance.

The control system allows information about each plate to be obtained from current and voltage measurements (and other variables if measured) so that data on plate quality, size, flatness and alignment can be returned to a central control system for analysis. This information can be used in a quality control and quality improvement scheme thereby increasing the efficiency of the whole processing plant. Hence a benefit of the invention is the ability to obtain information about individual cells and electrodes through monitoring electrical quantities at the individual converters.

An advantage of the invention is that the voltage at which the cells are supplied is not determined by a trade-off between safety and efficiency. While the traditional approach of operating tanks in series may raise the dc voltage employed and hence the efficiency of the rectification process, the danger of electric shock and dangerous fault conditions is increased. With controlled local conversion the power supply to the converters can be of any appropriate voltage since this power will be supplied through insulated cables. However, from inspection of FIGS. 4 and 5 we expect that no electrode is more than one cell voltage above earth potential. This will also minimise leakage current to ground through spilt electrolyte. Where, for example, there are many cells in a tank, one electrode (for example an anode) may be grounded so that all other cathodes and anodes remain within a few volts of ground potential.

A further advantage of the invention is that fault current resulting from a short circuit between plates can be controlled and the presence of a short circuit detected quickly. The change in V-I characteristics of the cell can be used to detect the growth of a metal spike before it forms a complete short circuit enabling the potential fault to be reported and remedial action to be taken before a complete short circuit is formed.

Figure 16:
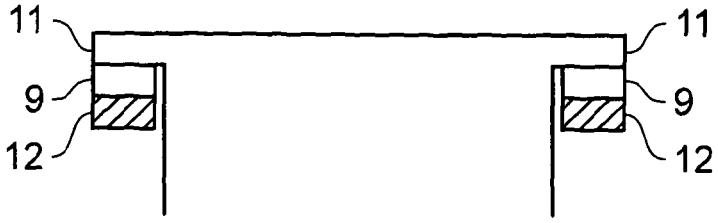
FIG. 16 is a front view of an electrode wherein regulators have been inserted between the electrode lugs and the bus bars.

FIG. 16 illustrates an identical configuration to FIG. 7*b* but with both sides of the electrode shown for completeness. The electrode lugs or hanger bar ends 11 rest on a regulator or converter 9 and a bus bar 12. The converter 9 controls current flow between the lugs 11 and the bus bars 12.

Multiple power supplies can optionally be used for driving either cathodes or IEGs as shown in FIG. 16. In such circumstances it may be desirable to give each power supply more current or power capacity than it would need in normal operation. Hence, should one of the converters fail, the other converters can take up the load, there by permitting a cathode or cathode side to harvest its full quota of metal in the allotted time despite the failure of a power supply.

In case where more than one power converter is used per electrode, the plurality of converters associated with each cell may be under the control of a common control system and to each supply an appropriate fraction of the current required by the cell. If the plate was operating in conjunction with electrodes on each side of it (that is driving the cells on each side of it as shown in FIG. 5), it is therefore possible that each lug, for example as shown in FIG. 16, would have two converters attached making a total of four per plate (two per cell where a cell is here used to describe the gap between one anode plate and one cathode plate). Therefore in a single tank containing a number of interleaved anode and cathode plates there could be converters between each of the cathode-anode lug pairs on each side of the tank so that there would be twice as many converters in use as there are plates (anode and cathode numbers combined). The current density between a side of an anode plate and the side of the cathode facing it would remain the main target of the control system associated with a pair of converters. The converters connected to the same plates but on opposite sides of the tank would need to communicate if they are to share the current load for the anode-cathode gap equally.

Figure 17:
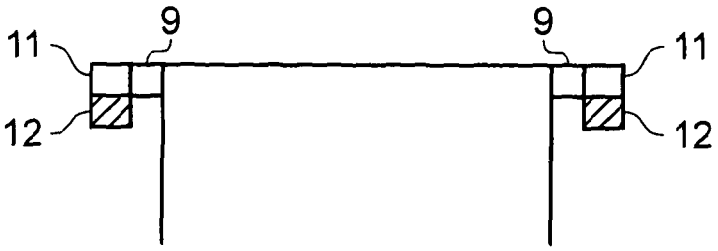
FIG. 17 is a front view of an electrode wherein regulators have been incorporated into the lugs.

FIG. 17 illustrates an embodiment in which a plurality of regulators 9 are incorporated into the lugs 11, but electrically still fulfilling the same role as those in the configuration illustrated in FIGS. 7(*a-c*) and 16.

Figure 18:
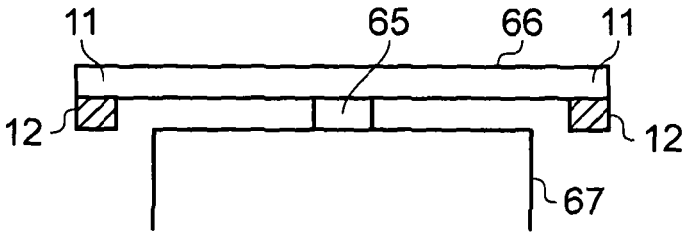
FIG. 18 is a front view of an electrode wherein two regulators have been incorporated into a single regulator separating the main plate with the lug beam.

Alternatively, the two regulators may be combined into a single unit and moved to between the bar 66 with lugs 11 and the electrode plate 67 as shown in FIG. 18.

Figure 19:
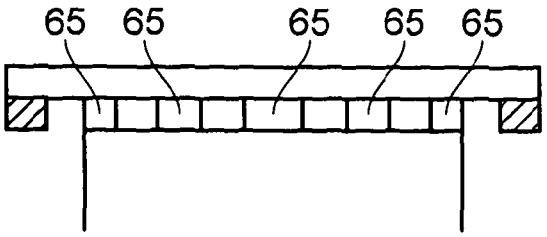
FIG. 19 is an illustration of a modification to the embodiment shown in FIG. 18 with multiple regulators.
Figure 20:
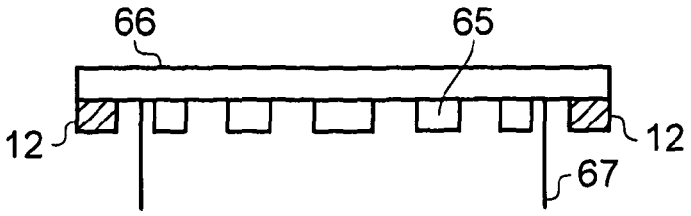
FIG. 20 a more mechanically robust version of the arrangement shown in FIG. 19.

So as to achieve a better current distribution in the plate 67 multiple regulators 65 may be disposed between the hanger bar 66 and the plate as illustrated in FIG. 19. FIG. 20 shows a more mechanically robust version of the arrangement shown in FIG. 19 as will now be described with respect to FIG. 21.

Figure 21:
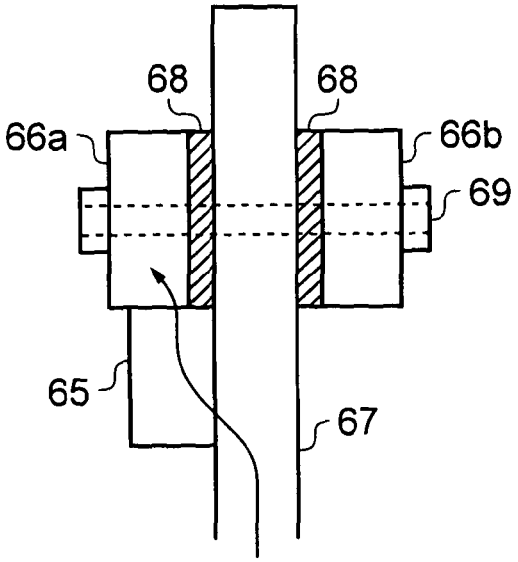
FIG. 21 is an end-on perspective of the arrangement shown in FIG. 20.

FIG. 21 illustrates the hanger bar 66 of FIG. 20 end on rather than face-on to the hanger bar 66 and plate 67. As shown, the hanger bar 66 may be divided into two parts 66*a* and 66*b* to give mechanical balance. Preferably, the hanger bar is electrically insulated from the plate 77 by insulators 68. A connection bolt 69 is preferably made of insulating material or is otherwise insulated either from the hanger bars 66*a* and 66*b* or the plate 69. Current passes (in the case of the cathode) from the plate to the hanger bar through the regulators 65.

Figure 22:
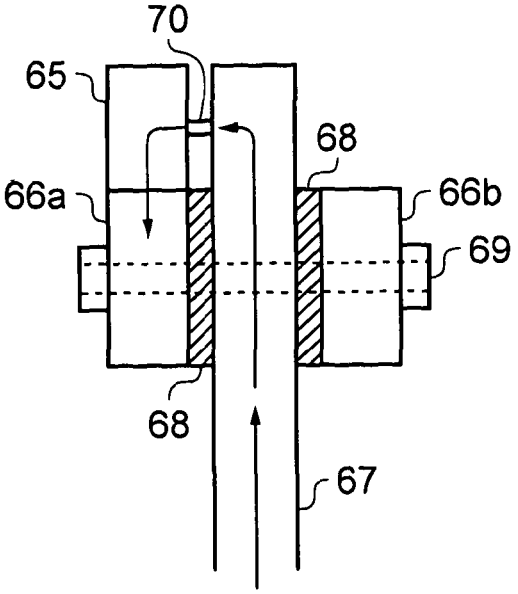
FIG. 22 is a end-on perspective of the arrangement shown in FIG. 20, wherein the regulators have been positioned in an alternative arrangement.

The regulators 65 may be placed in an alternative position. For example, as shown in FIG. 22, the regulators 65 are situated above the hanger bar 66, the electrical insulator 68 also providing thermal insulation and the hanger bar 66 dissipates heat from the regulators 65 into the ambient air. An electrical conductor 70 provides an electrical connection without permitting much heat to flow into the converter 65.

The hanger bar or lug resistance may not be insignificant. In the traditional ER or EW system the hanger bars or electrode lugs rest on and make contact with bus bars running along the edges of the tanks The surface to surface contact has resistance which can insert a voltage drop (typically of the order of 20 mV for copper ER) in the electrode path. The total voltage drop for both electrodes can be 40 mV. The inventor has realised that this is not only responsible for a serious loss of energy, but also provides a further potential source of imbalance of current density between sides of the cathode electrodes since anodes on each side of a cathode plate may not be at equal potential if the potential drop in their contacts is not the same for each anode.

Figure 10:
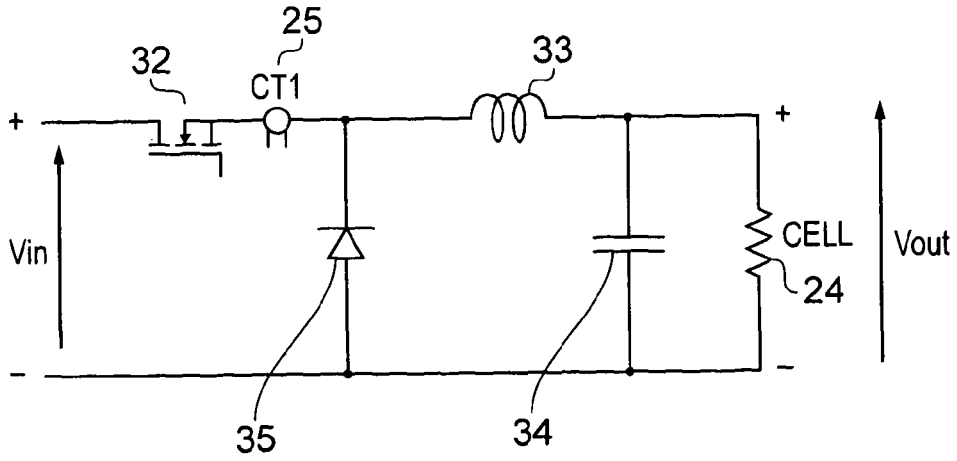
FIG. 10 is a circuit diagram of a buck regulator.

FIG. 10 shows a buck regulator which may be used as an alternative to individual converters supplying individual cells but still applying the principle of using current measurement and current control to improve cell performance. The converter comprises power MOSFET 32, inductor 33, capacitor 34 and diode 35. Vin and Vout will be of closer in magnitude than in the converters previously discussed. Indeed, the input voltage may only be a small percentage above the output voltage and the duty cycle of the converter switch may be close to 100%. However, the circuit does provide current control and an opportunity for current measurement using an ac current transformer (with reset) if desired. The converter can be inserted between the bus bars and the plates of a conventional electrorefining or electrowinning system. Diode 35 can be replaced by a synchronous rectifier (another power MOSFET) to increase the efficiency of the regulator. Inductor 33 may be dispensed with (along with capacitor 34) if ripple current in the cells is acceptable.

Control is applied to the regulator in the manner previously discussed for other converters. Where this type of converter is retrofitted to existing plant it is likely that the dc bus voltage (input to the converter) will need to be raised slightly to give some headroom within which the PWM control circuit can operate. An auxiliary converter or auxiliary supply may be needed to provide a power supply of adequate voltage for the control circuitry. Current can be measured by an ac current transformer CT1 25 as long as the duty cycle is less than 100%.

The values of current used in EW and ER are large with respect to the magnitude of current that can be sensibly carried by one transistor. One solution is to operate converters in parallel. This solution is sensible where it is used to spread the delivery of current to various sites of an electrode. However, the disadvantage of this solution is that where a single delivery point of current (or regulation of current) is envisaged, paralleling converters may be uneconomic because each converter will have associated with it the cost of a case, terminals, emc filter, etc.

Hence the preferred solution is to use a multiphase design within each converter. The advantage of the multiphase solution is that inductor sizes become reasonable. Inductors that are of too high a current value while at the same time having too high an inductance value are not optimised. This has advantages too in the transformer version in which leakage inductance between the primary and secondary windings, which can give rise to loss of output voltage, can be ameliorated by the multiphase approach.

Figure 11:
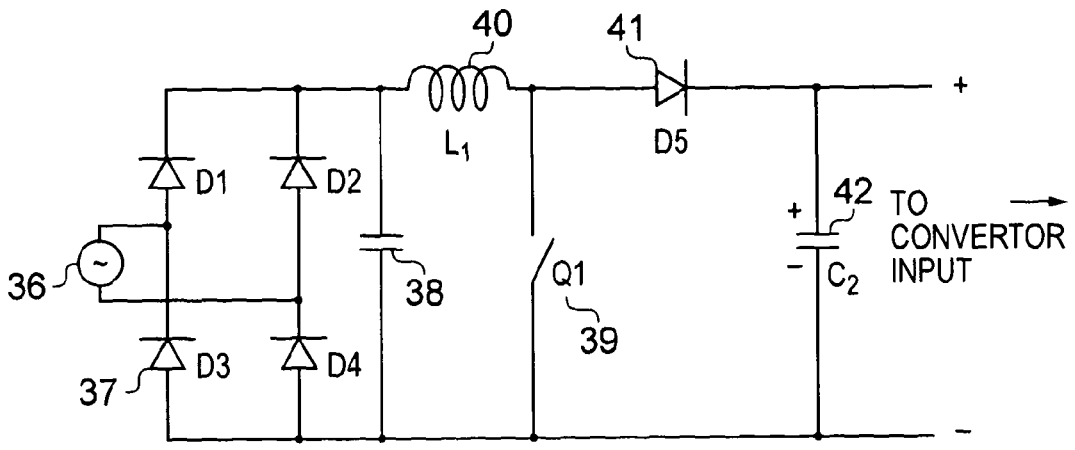
FIG. 11 is a circuit diagram of a power factor correction circuit.

FIG. 11 shows a converter operating from an ac supply 36 with a power-factor correction (PFC) circuit at the front end in accordance with an embodiment of the invention. The ac to dc conversion on the primary side could take place using a simple rectifier and bridge rectifier but with large loads power factor correction is usually required at some point. If power is distributed to the converters at, for example, 48V dc, the 48V dc supply can be generated at suitable points throughout a tank house with power factor correction. FIG. 11 shows a PFC circuit which will be readily recognised by a person skilled in the art of power electronics. The ac input is full-wave rectified a full wave rectifier comprising diodes (D1 to D4) to produce a full-wave rectified voltage waveform. A capacitor 38 is a small by-pass capacitor for high-frequency switching current components. An output of the rectifier is provided to an inductor 40, a diode 41 and a reservoir capacitor 42. A semiconductor switch 39 is operated in such a manner that the current through the inductor has the same waveform (apart from high-frequency ripple) as the full-wave-rectified voltage waveform. After steering by the diodes in the full wave rectifier bridge 37, this current waveform emerges as an ac current waveform in phase with the ac voltage waveform. Typically there is a control loop which maintains the average voltage across the reservoir capacitor 42 at the desired value. This dc output is then used as the input to the individual cell converters described elsewhere. This raises the possibility of operating the cell dc-dc converter at full duty cycle (in the case of transformer-based converters that is at maximum voltage transfer ratio) and having the current control loop operate not on the cell converter duty cycle but on the PFC circuit so that the PFC converter extracts the right amount of power from the ac supply to give the desired current in the cell. The advantage of this is a simplification of the overall control circuitry. Control loops are not duplicated unnecessarily and the form factor of the current waveforms in the power MOSFETs of the cell converter is optimal, thereby minimising losses in those devices.

An advantage of employing multiphase converters is that the current ripple in the output can be reduced to zero in an economical fashion. It is generally unacceptable for a dc power supply to deliver a large amount of ripple in its output voltage or output current. Hence switched-mode converters are usually endowed with a filter arrangement which reduces these ripple components to acceptable magnitudes. However filter components are expensive. If a multiphase converter is used and it has a duty cycle of 1/N where N is the number of phases employed, the ripple current can be reduced to zero with no further filtering. Output voltage (and hence output current) can then be controlled by varying the input voltage to the multiphase supply. If the converter derives its input from an ac-dc PFC stage, the PFC stage can be controlled so as to vary its output voltage. A 2:1 variation in the output voltage of commonly used PFC stages is possible which will be adequate to effect the degree of variation of the voltage and current required to be delivered to EW and ER cells in normal operation.

In embodiments in which a regulator is inserted between the bus bars of a traditional tank system and the plate of the electrode, typically a cathode, adjustment can be made to the current entering the plate in the conventional tank house system in which power is supplied from a central source.

Optionally, the voltage supplied by the traditional central dc power source may be elevated slightly to give the regulator some headroom within which to operate so that it can permit normal current to flow, notwithstanding the voltage drop inserted by the regulator.

Alternatively a power supply may be inserted between the electrode and the traditional system bus bars. Hence this power supply may add to the voltage difference between anode and cathode. For example, if the anode voltage is taken as being at 0V, if a cell is considered in isolation and the anode voltage taken as the reference voltage, the cathode bus bar might typically be at −0.32 V. If it is desired to raise the electrode current (typically the cathode current) to a value above its normal level, extra voltage can be injected into the anode-cathode path via the power supply to say, 0.39V adding 0.07V to the total available voltage. Hence, to extend the example, a 600 Amp, 0.07V auxiliary power supply would be required. The power supply may be a well known buck regulator circuit or other well known switched-mode power supply circuit. This auxiliary power supply may or may not be capable of shutting off current flow to the electrode (for example in the case of a short) depending on the circuit used for the power supply. Most of the power used in the cell will come from the conventional bus bars and centralised supply and the power being delivered from the auxiliary power supply will only be a fraction of the total, this fraction being determined by the proportion of total voltage supplied by the auxiliary power supply. The advantage of this is that only a fraction of the total power consumed in a tank has to be delivered to the tank by a new power supply arrangement at the tank location. This modest amount of power may be delivered by traditional means (e.g. cables, contacts or connectors) or it may be delivered by alternative means such as inductive power transfer.

In embodiments where the regulators or power supplies are integral parts of the hanger bar and/or electrode plate assembly, heat generated in the regulators or power supplies can be conducted into the plate and thus the electrolyte. However, the electrolyte is typically at 55 to 60 degrees C. for ER and 40 to 45 degrees C. as for EW (for example in copper processes) and the heat generated in the regulators can be reduced to almost zero by using large numbers of power MOSFETs in parallel, cost being practically the only limiting factor in reducing the resistance of the parallel MOSFET combination in which case it is likely that the electrolyte will heat the transistors rather than cool the transistors.

In which case the transistors should be thermally isolated from the plate which dips into the electrolyte and the transistors provided with a separate cooling arrangement. This could be a finned, ambient-air cooled heat sink. Alternatively the hanger bar could be used as a heat sink.

Where the invention is being incorporated in an existing plant as a retrofit exercise, it may be practical to take advantage of the existing equaliser bar system. There are various systems available. Typically the equaliser bar will aim to connect together cathodes or anodes on either side of the tank so that across each tank anodes and cathodes are at a uniform voltage. Another objective is to maintain a path for current to flow to or from an electrode should one of its lugs (hanger bar ends) become contaminated and fail to connect properly to the anode or cathode bus from which it should collect or deliver current. This means that a positive and a negative bus rail are both present along the edges of each side of a tank with a potential across them equal to the voltage drop between the anode and cathode of a single cell. This can be used as a power supply for a converter located on the cathode which raises or lowers the cathode potential above or below its normal voltage in order to fine-tune the current drawn by that cathode. Alternatively, the equalising bars can be employed in a retrofit to supply ac to power supplies on the cathodes or at the side of the tanks when supplying the IEGs.

A three-phase ac power supply system will usually be the source of power for a tank house. A copper ER tank with 60 cathodes will require about 14 kW. A copper EW tank with 60 cathodes will require about 75 kW. Both these power levels could be supplied from a single-phase transformer. However, it may be desirable to present a balanced load to the three-phase supply which would almost certainly be supplying a metal refinery or metal EW system. In the interests of safety different phases of a three-phase system should not be in close proximity to each other because in a three-phase system the line-to-line voltage is substantially greater than the line to neutral voltage. A good arrangement therefore would be that each tank operates from a single phase but that tanks are divided into blocks of three with each one being supplied from one of the phases of a three-phase, four-wire supply.

When the power supplies are fed from single-phase AC, it may be convenient to use both conductors as live conductors so as to reduce the live to ground voltage in the interests of safety. So, for example, rather than supplying the power supplies from two conductors, one at 230V with respect to ground (the live) and one at 0V with respect to ground, it will be safer to supply both conductors with 115V with respect to ground (that is, two anti-phase lives). This could be particularly important where the AC conductors run along the sides of the tanks in an exposed manner. For example, adjacent edges of two side-by-side tanks could carry live A at say, 57V while the other sides of these tanks could carry live B (in anti-phase to live A) at 57V. Hence a shock at 114-115V could only be obtained by touching the conductors on opposite edges of any given tank. A Residual Current Circuit Breaker can be used to protect users from shocks resulting from touching any of the 57V rails.

If an ac supply is used to supply power to the converters, transformers can be placed at suitable locations in a hall containing many tanks to step down the voltage in stages so that power can be supplied to selected locations at a high voltage and there transformed down to a lower voltage for distribution to the individual converters. Hence power transmission takes place at a voltage appropriate for the level of power being transmitted resulting in reduced electrical power loss. Alternatively power may be converted at selected locations to a lower voltage dc supply. Power factor correction can be applied at these locations or at individual cell converters if they are supplied with an ac supply. Details of the various embodiments will be explained in more detail below.

Figure 37:
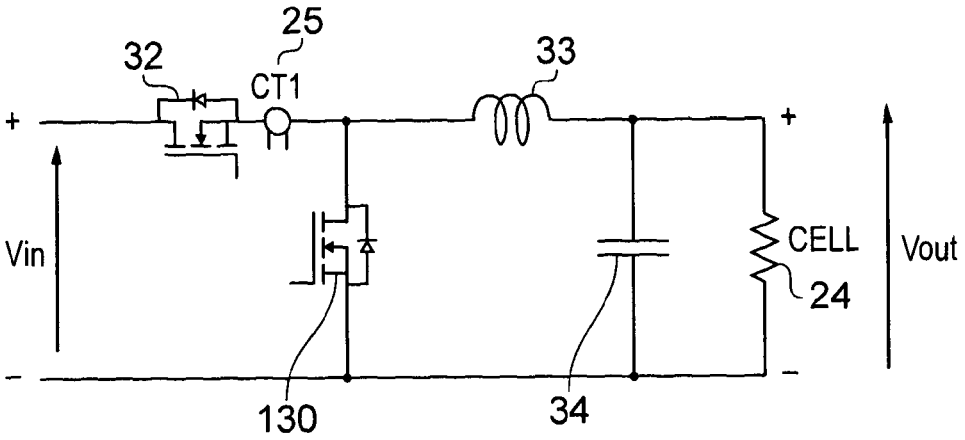
FIG. 37 is a circuit diagram of a buck regulator with a synchronous rectifier carrying the freewheeling current.
Figure 38:
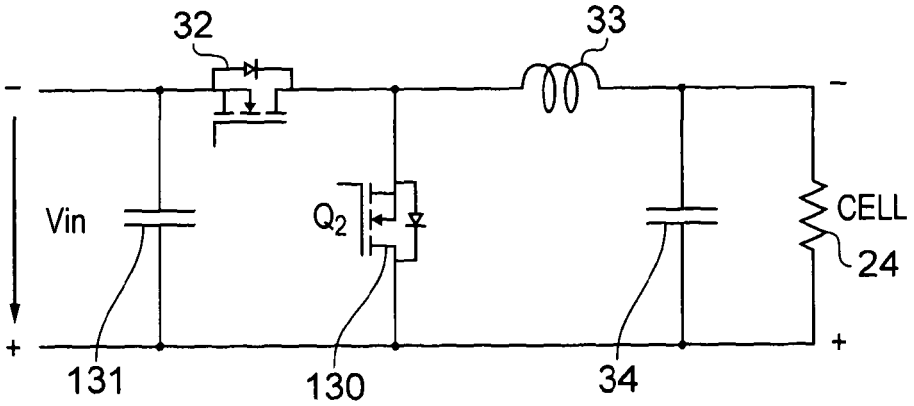
FIG. 38 is a circuit diagram of a buck regulator adapted for driving cathodes.

As an alternative to a high-voltage power supply (that is one significantly greater than the individual cell voltage) a power supply of a voltage close to the cell voltage can be used. Typically this might be used when it is required to employ the converter and its control system in a tank house of a design very close to that presently employed. A buck converter, such as that illustrated in FIG. 37 can be employed between the presently used dc bus-bar power distribution system and the electrodes. FIG. 37 shows a switched-mode buck regulator as described in FIG. 10 except that the diode 35 has been replaced by a power MOSFET 130 operating in the synchronous rectifier mode in order to improve the efficiency of the circuit. In this case the current entering and leaving a plate would be controlled by a converter (or converters) placed between lugs and the dc low voltage bus bar. Where current is passing into or out of a plate through more than one connection point (e.g. lug) the current setting for each converter would have to take this into account and where the current level was modified during operation the separate converters would have to be informed of the change or would need to communicate with each other. The use of synchronous rectification can be used in the freewheeling part of the circuit to increase the efficiency of the regulator. In the case of EW the anodes are permanent but in the case of ER the anodes are soluble. Hence in the case of ER the regulator is more likely to accompany the cathode. FIG. 38 shows the circuit of FIG. 37 adapted for optimal use with a cathode. Capacitor 131 has been added to provide a path for high-frequency ac currents. The inductor 33 along with the capacitor filter 34 smooth the switched waveform at the drain of MOSFET 32. The presence of the inductor 33 in this filter circuit makes it necessary to include a second MOSFET 130 to provide a circulating current path for the current in inductor 33 when MOSFET 32 turns off However, these are relatively expensive components.

Figure 39:
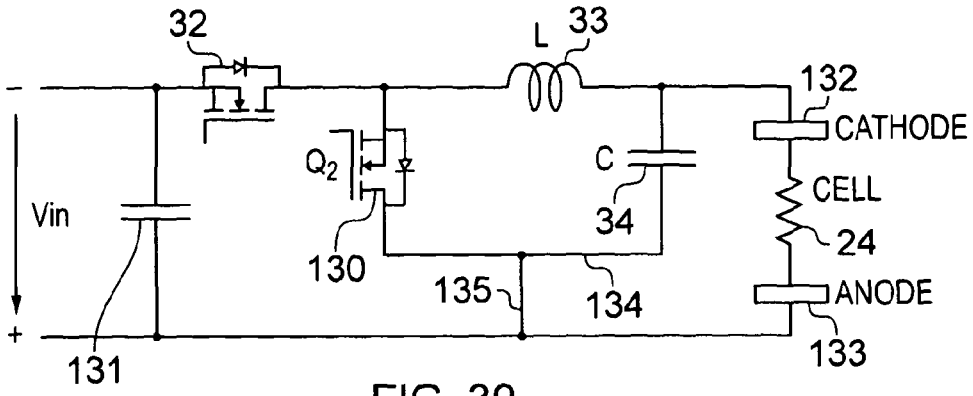
FIG. 39 identifies the physical elements in operation in conjunction with the circuit shown in FIG. 38.

FIG. 39 identifies some physical elements of the circuit shown in FIG. 38. The cell 24 is composed of the electrolyte physically present between a cathode plate 132 and an anode plate 133. A circulating current in inductor 33 circulates through MOSFET 130 when MOSFET 32 turns off. The branch 134 of the circuit provides an dc source or sink at anode potential for the circulating current. By virtue of the capacitor 34 it is also an ac ground. Branch 135 of the circuit connects branch 134 to the anode as well as the positive terminal of the power supply and may have a distinct physical reality.

When multiple switched-mode regulators are employed in parallel on a single cathode, It is possible to dispense with the filter elements and freewheeling diode (or synchronous rectifier MOSFET) in each of the regulators provided that when a switch is turned off there is a path through which the current circulating in the parasitic inductance of the plate. This will generally be the case because the MOSFETs 32 will be on most of the time since the power supplies, when operating as regulators which fine tune the current in the traditional ER and EW situation, will be operating with a Pulse Width Modulation duty cycle close to unity. If a suitable switching pattern is adopted for the MOSFETs 32 the current in the hanger bar can be kept approximately constant in which case there will not be any high rate of change in the current in the hanger bar which could interact with parasitic inductance to cause over voltage of the MOSFETs. Even so, it is possible that high values of di/dt interacting with parasitic inductance will cause over voltaging of the MOSFETs used for the switches. However this need not be a problem as most MOSFETs are rated for operation in avalanche. To further reduce the possibility of any excessive voltage due to parasitic inductance the rate at which the MOSFET 32 is switched (and hence di/dt) may be reduced—that is to say, its turn-on and turn-off time may be lengthened. This will increase the switching loses in the MOSFETs but these should be tolerable. In order to soften the switching further the amplitude of the switching control waveform applied to the gate of each MOSFET may be kept at a relatively low amplitude to prevent over-abrupt switching of the MOSFET. A major advantage of a switched-mode regulator such as this is that low cost ac current sensors can be employed to provide accurate measurement of the current for monitoring and control purposes.

Figure 40:
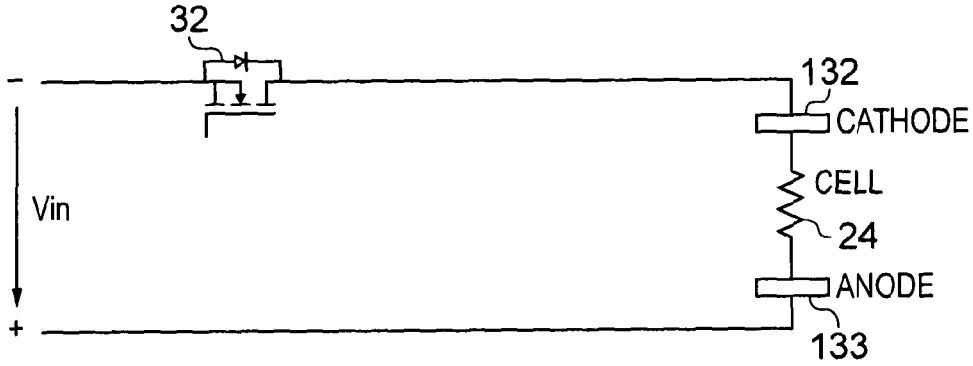
FIG. 40 is a circuit diagram of a simplified switched-mode regulator to be used with other switched mode regulators in time-interleaved fashion so as to maintain a constant current in the hanger bar.

MOSFETs 32 are united by large conductors which help to reduce the parasitic inductance between the MOSFETs 32. Hence, in the interest of economy and as a result of the above observations the regulators in FIG. 39 may be reduced to a single MOSFET 32 each as shown in FIG. 40.

Figure 41:
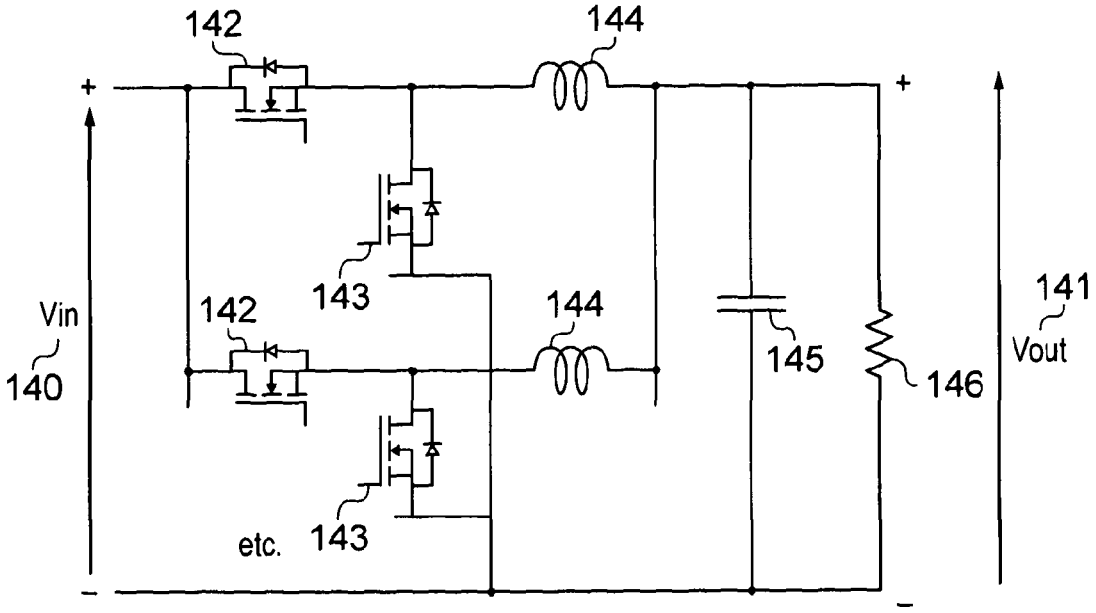
FIG. 41 is a circuit diagram of a multiphase buck converter.

FIG. 41 is a multiphase buck regulator circuit suitable for stepping down voltage in high-current situations. An input supply 140 is converted to an output 141 of a lower voltage. MOSFET switches 142, MOSFETs 143 used as a synchronous rectifier, and an inductors 144 constitute the components of each phase. All phases contribute to the output 141 which is smoothed by a capacitor 145. The output is supplied to a cell 146.

Figure 42:
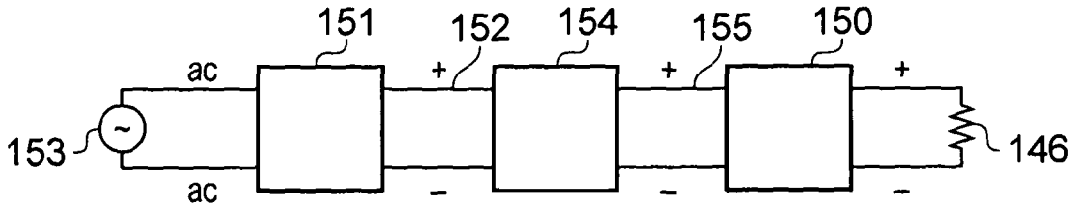
FIG. 42 is a schematic diagram of a power management system in accordance with one aspect of the invention.

FIG. 42 is a schematic diagram of one possible overall power management system arrangement. The cell load represented by resistor 146 is supplied by a buck (single phase or multiphase) converter 150. Converter 151 creates a dc supply 152 from an ac supply 153 (e.g. 230V, 50 Hz). This converter 151 may include a power-factor correction stage. An intermediate supply 152 may be any convenient dc voltage but may also be the dc voltage derived from a power factor correction stage and may contain substantial voltage ripple as well as being of a voltage greater than the peak voltage of the ac supply 153. For efficient functioning of the buck regulator 150, the intermediate voltage supplied to it at the intermediate voltage rails 155 should not be too far removed from the output voltage (i.e. the cell voltage). Typically the input voltage of this converter should not be much more than ten times the output voltage when the converter is a simple buck converter. Hence an intermediate converter 154 may be required to convert the output voltage of converter 151 to a voltage appropriate for input to the converter 150. The input voltage to the converter 150 can be much higher when it is a transformer based converter, examples of which were described with respect to FIGS. 8 and 9.

In order to convey dc current to the cathodes and anodes in an ER or EW situation an optional alternative solution is provided. Accordingly, power supplies are carried on a bar or frame (support bar) resting on the either the tank sides or on the electrodes themselves and passing electricity to the electrodes via sprung contact pins or shafts which press onto the electrodes or their hanger bars. The pins are connected to their respective power supply terminal via flexible conductors. These conductors provide an opportunity for the incorporation of dc current transducers if required, the flexible conductor being able to pass easily and conveniently through the window of commonly available dc current transducers. The support bar may be independently supported or it may be supported by the sprung pins resting on the electrodes. Pressure from the bar causes the pins to be forced into contact with their respective electrodes either by the weight of the bar and the components it carries or by the support bar being pressed down towards the electrodes by some means and being fixed in that position. The support bar along with all the components associated with it can be removed from its service position when it is required to replace the anodes or remove the cathodes for cropping. Two or more support bars running the length and joined at the ends by an insulating cross member may be employed. Various embodiments and options are described below.

Figure 23:
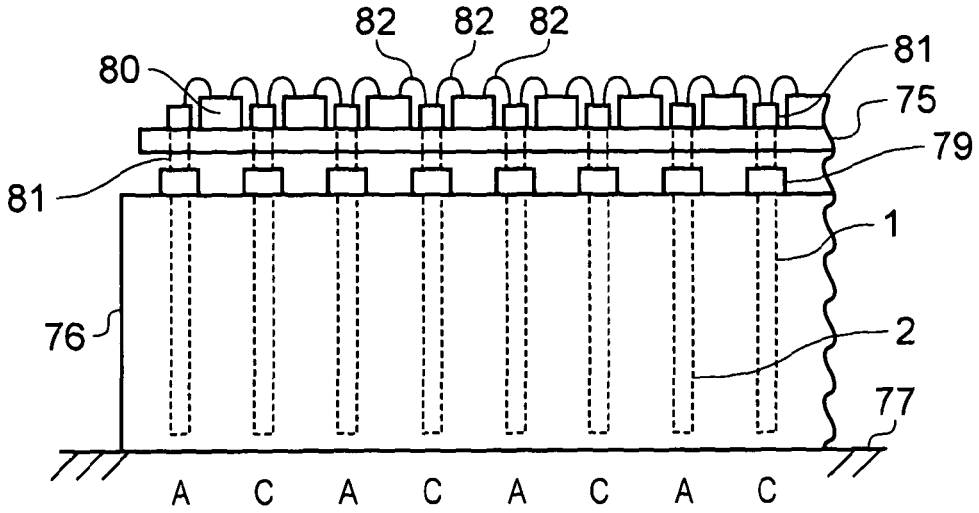
FIG. 23 is a side view of a tank, illustrating how the power supplies may be carried on a support bar above the tank contacting electrodes via sprung pins in accordance with an embodiment of the invention.

FIG. 23 shows how the cells, and specifically the IEGs in a tank may be driven from power supplies carried on a bar 75 above the tank 76. The tank 76 stands on the ground 77 and is viewed side-on—that is, looking at the electrodes edge-on. The tank may be of any extension and contain any number of anodes and cathodes. The tank contains cathodes 1 and anodes 2. Items 79 are hanger bars or lugs associated with each electrode which support these electrodes on insulated bearers along the side of the tank 76. The power supplies 80 which supply dc to the IEGs are carried on a support bar 75. Metal pins or shafts 81 pass though or beside the support bar 75 and are insulated from the support bar 75 by an insulating sleeve if the support bar 75 is a conductor. If the support bar 75 is made of insulating material then the insulating sleeves are not required. The pins 81 are spring loaded so that once in contact with the electrodes on which they press they are to some degree compliant. The pins 81 make contact with the hanger bars (typically in the case of a cathode) or with the electrode surface (typically in the case of an anode).

Figure 24:
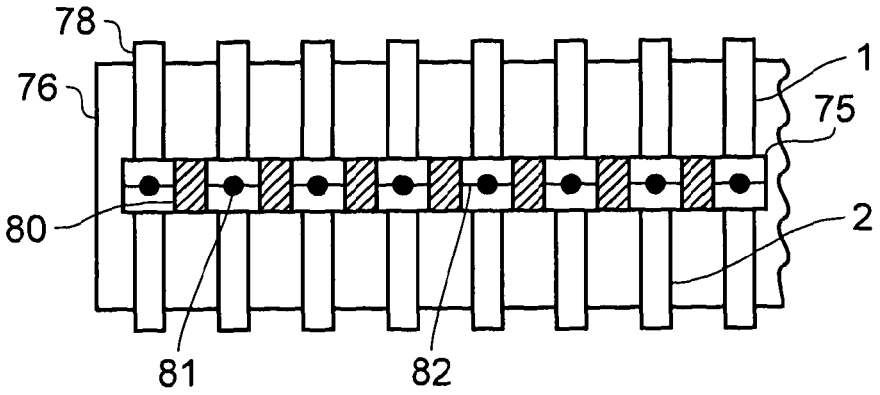
FIG. 24 is a top view of the arrangement shown in FIG. 23.

The hanger bars (e.g. of the cathodes) may have a special metal patch where contact is made by the pins 81 to ensure good electrical contact. The electrodes (e.g. of the anodes) may have an area of their metal surface specially prepared to receive contact with the pin 81 so that there is a good electrical contact between them. The power supplies 80 on the support bar 75 provide a supply of dc current which is fed to the anodes and cathodes. Wires 82 connect the positive output of the power supplies 80 to the anodes and connect the negative output of the power supplies 80 to the cathodes. The support bar 75 may be independently supported or it may be supported by the sprung pins 81 resting on the electrodes. The principle of operation of this arrangement is that pressure from the bar 75 causes the pins 81 to be forced into contact with their respective electrodes either by the weight of the bar 75 and the components it carries or by the support bar 75 being pressed down towards the electrodes by some means and being fixed in that position. The support bar 75 along with all the components associated with it can be removed from its service position when it is required to replace the anodes or remove the cathodes for cropping. FIG. 24 shows the same arrangement as in FIG. 23 but viewed from above.

Figure 25:
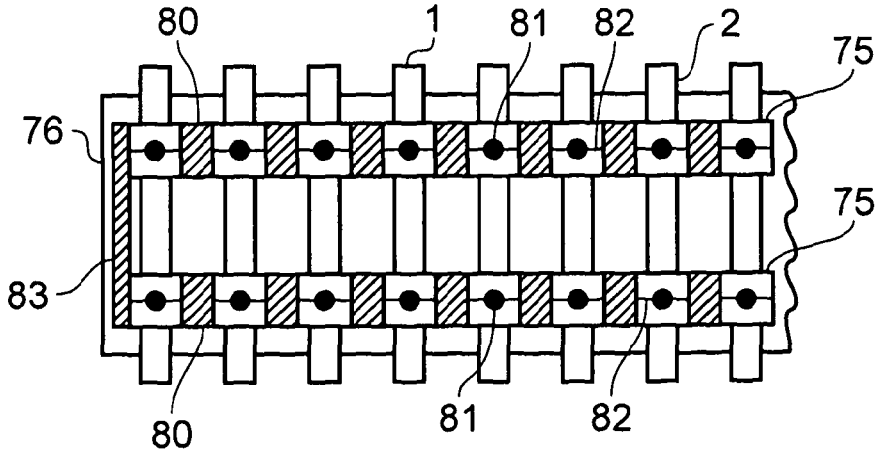
FIG. 25 is a top view of a tank, where two or more support bars are employed in the support bar arrangement.

Alternatively, two or more support bars run the length of the tank as is shown in FIG. 25. Two bars 75 are used in the illustration by way of example but any number of bars 75 may be employed. The bars 75 are joined at each end of the tank and where appropriate by cross members 83, the whole assembly of cross members 83 and bars 75 therefore forming a frame. The advantage of a frame is that when placed on top of the tank, and particularly when supported only by the pins 81 bearing on the electrodes 77 and 78. It will be appreciated that there are a variety of ways of making a stable frame all of which are encompassed within this invention.

The power supplies may be carried on bars 75 or they may be carried on non-active bars or on a platform supported by the support bars 75 or by non-active bars.

The power supplies may derive their power from, by way of example:

1) a single-phase ac power supply feeding each of the power supplies with PFC (Power Factor Correction) included in the supplies;
2) a single-phase ac power supply feeding each of the power supplies without PFC included in the supplies;
3) a single phase ac supply feeding a number of PFC units (not necessarily the same number as the number of supplies), these PFC units each supplying a number of power supplies with dc, in which case the power supplies are dc-dc converters;
4) a three-phase power supply feeding either of the option described above but with the load being distributed between the three phases of the three-phase supply;
5) a three-phase ac supply feeding ac-dc converters (rectifiers) without PFC stages benefiting from the improved power factor correction and harmonic elimination opportunities afforded by a three phase supply. The intermediate dc supply thus created can be fed to the power supplies which then are dc-dc converters;
6) a dc power supply in which case the power supplies are dc-dc converters.

Flexible cables may connect the frame or bar to these power sources. The cables can feed the bar or frame either at the end or ends of the bar or frame. Alternatively the cables can feed the bars or frames at some central or common point. The cables can bring power in either from an overhead distribution system or from a distribution system alongside the tanks or at the end or ends of the tanks The flexible cable supply may optionally include a plug and socket connector for connection and disconnection.

Alternatively, the power may be brought to the frame through pressure contacts carrying ac or dc. The frame can in this situation be moved without the need to disconnect any plug and socket system.

Where supplies are hot swapped advantageously there is an arrangement to prevent arcing, for instance by having the supplies shut down monetarily during the swapping process.

One of the problems of the ER or EW environment is the presence of an electrolyte which can be deleterious to electrical contacts. Where ac power is being conveyed, the technique of inductive power transfer can be advantageously employed. In such a power transfer system there is a power sender unit and a power receiver unit which are placed in close proximity, preferably touching. The sender unit is effectively the one half of a transformer magnetic core and its primary winding while the receiver unit is the other half of the magnetic circuit and the secondary winding. No electrical conductors need be exposed in either half. The magnetic cores are brought together as closely as possible so that there is as little distance as possible between the magnetic cores. Ideally they should be in contact. If the magnetic core material is likely to be damaged by the electrolyte, it may be necessary to cover the core surfaces in a thin protective film of chemically inert material. Various configurations of core shapes are possible (e.g. a blade within a forked core, a cone within a conical receiver or a simple E to E core or circular (pot type) core to circular core). Inductive power transfer would also remove the need for arc prevention schemes in the case where hot swapping is employed.

Figure 26:
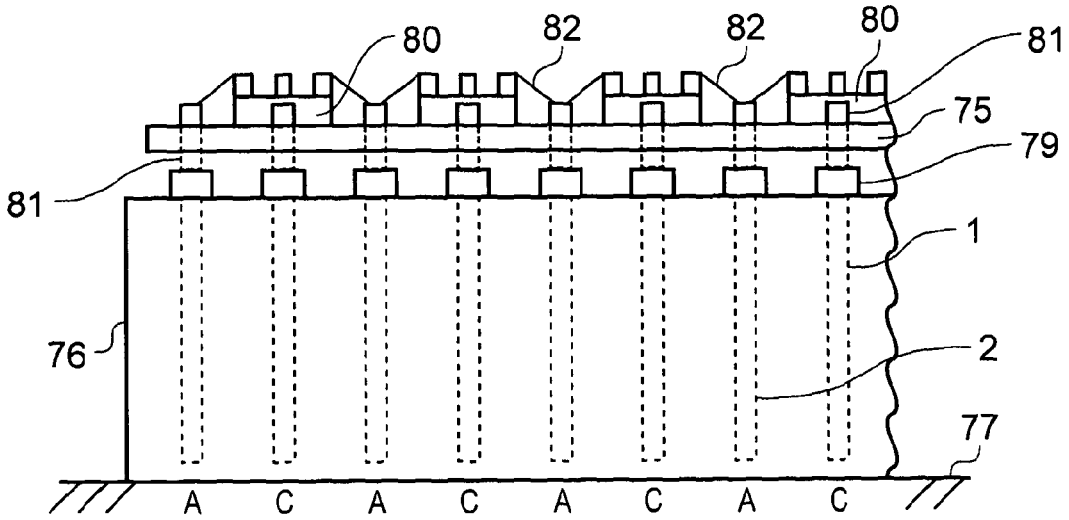
FIG. 26 is a side view of the tank, illustrating how a support bar system can be used to drive cathodes.
Figure 27:
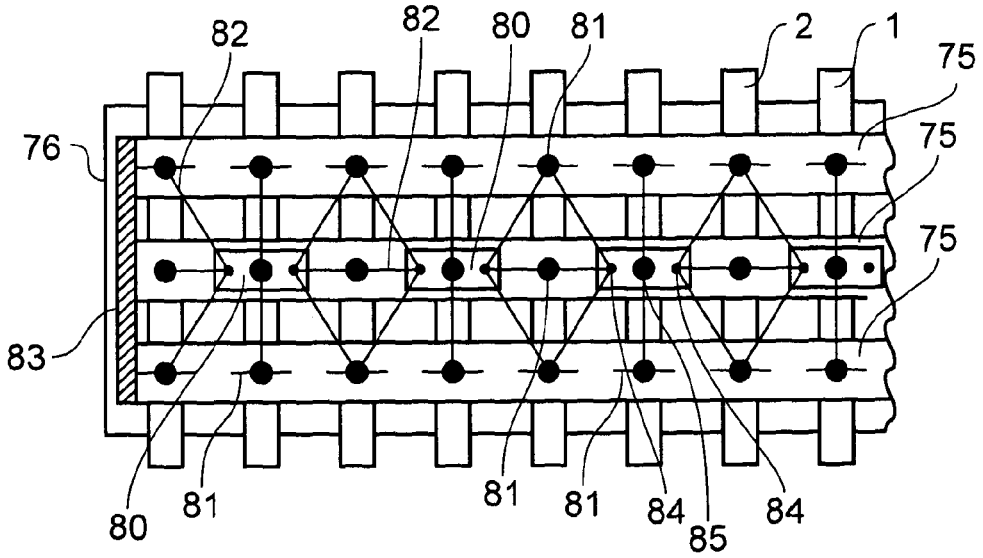
FIG. 27 is a top view of the arrangement shown in FIG. 26.

Alternatively, power may be fed to the cathode, as opposed to the IEG as is illustrated in FIGS. 26 and 27. FIG. 26 shows the side view of the tank (similar to that of FIG. 23).

FIG. 27 shows the view from above (similar to that of FIG. 25). The power supplies 80 have two common positive terminals 84 and one negative terminal 85 . There are three active bars forming a frame as previously described. It will be understood from the foregoing that there are many possibilities of combing active and non active bars in a frame. The negative terminal 85 of the power supply 80 is connected to the pins that feed a cathode via wires 82. The positive terminals 84 of the power supply 80 are connected to the pins that feed adjacent anodes via wires 82. Thus all the anodes are at the same potential.

Figure 29:
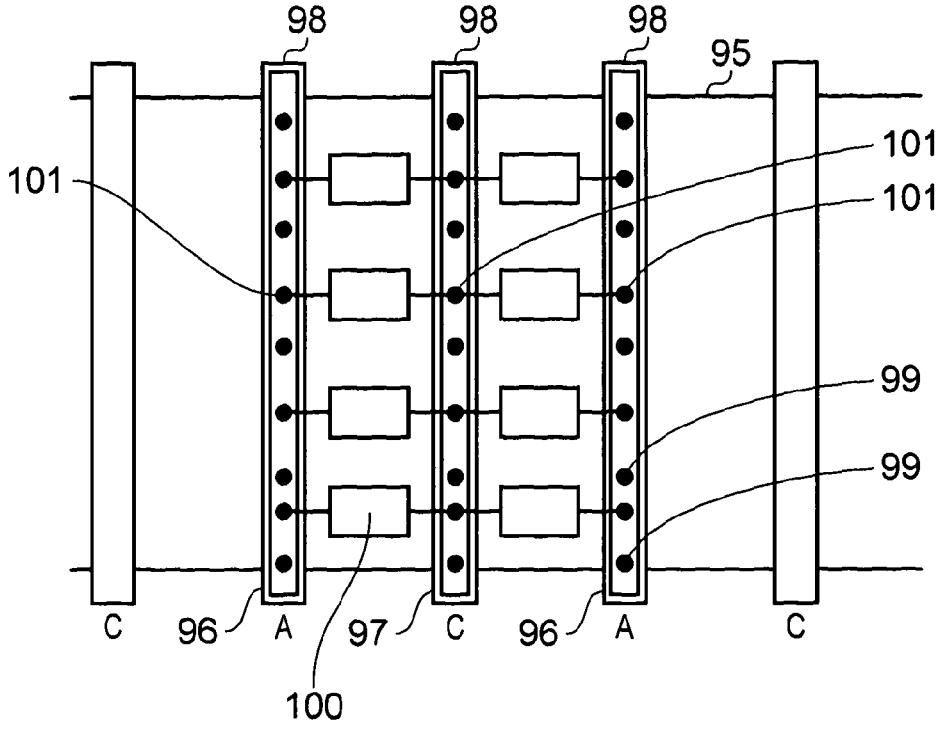
FIG. 29 is a top view illustrating a configuration of support bars in accordance with a further embodiment of the invention.

FIG. 29 shows an alternative orientation of a row of pins contacting the electrodes. FIG. 29 shows a view of a tank from above. Anodes 96 and cathode 97 are supported by lugs or hanger bars on the sides of the tank which are insulating. Support bars 98 run across the tank above the electrodes and lie in the same orientation as these electrodes. The support bars 98 carry sprung contacting pins 99 as before. The pins in one support bar may be connected together via flexible wire if the support bar 98 is of insulating material or the support bar 98 can be made of conducting material in which case it can provide the connection between pins. Insulating end-frame members connecting the support bars can give mechanical rigidity and form a frame. In the arrangement shown in FIG. 29 the IEGs are driven by the power supplies 100. In this example a number of power supplies (in the example there are four although any number of supplies , including one, is a possibility) drive each IEG. Hence the supplies are connected with their positive terminals connected to the support bar and pins above the anodes and the with their negative terminals connected to the support bas and pins above the cathode. Hence the supplies operate in parallel. Since they will be current-mode supplies they may naturally share the current load according to the setting of each or if this arrangement has a tendency to lead to instability they may be connected together by signal wires so that their contribution to the total current is controlled in a coordinated manner. Pins 101 represent the connection points where connection is made between the power supplies and the support bars (if conducting) or the wiring system if the support bars are non-conducting.

One virtue of the arrangement shown in FIG. 29 is that if power supplies are located only at the extremities of the interelectrode gaps (that is, near the sides of the tank) the gap between electrodes is visible and accessible from above so that the state of the gap can be inspected visually and if necessary shorts between electrodes can be removed physically (for example by knocking them off with an insulating rod inserted between the electrodes).

The multiple pin arrangement has the virtue of reducing this contact resistance since all the pins for one electrode are in parallel so that the total effective resistance is reduced by the multiple current paths which the pins provide.

The weight of the frame may be enough to ensure good contact of the spring-loaded pins with the electrodes. However, if extra weight is required on the frame, the frame could also carry one or more mains transformers for reducing the mains power supply to the power supplies. The load on the frame could, for example, consist of one single-phase transformer, three-single phase transformers operating from the same mains phase or three single-phase transformers operating from three different mains phases. Typically these transformers would step down from a voltage in the region of 1 to 3 kV to a voltage in the range of 110V to 250V for the supply of the power supplies. The step down mains transformers would be supplied by flexible cable form overhead or form the side of the tanks While in FIG. 29 contact to the electrodes is made via sprung pins 99, this need not be the arrangement for making contact with the electrodes. An alternative arrangement would be to allow with conducting support bar to rest on the upper surface of the electrode or its hanger bar so that contact is made continuously along the length of the electrode. By this means the contact resistance between the power supplies (via the support bar) and the electrodes can be reduced to a very low level. This is advantageous in reducing the losses in an ER or EW system. Typically as much as 10% of power can be lost in the contacts between electrodes and the bus bars in a traditional system.

Typically an overhead crane is available for loading and unloading electrodes from the tank and this can also be used for raising and lowering the frame bearing the transformers and the power supplies.

To permit the loading of fresh anodes or the cropping of the cathodes, access by an overhead crane will be required to the anodes and/or cathodes. This will require the temporary displacement of the bar or frame power supply system.

Figure 28:
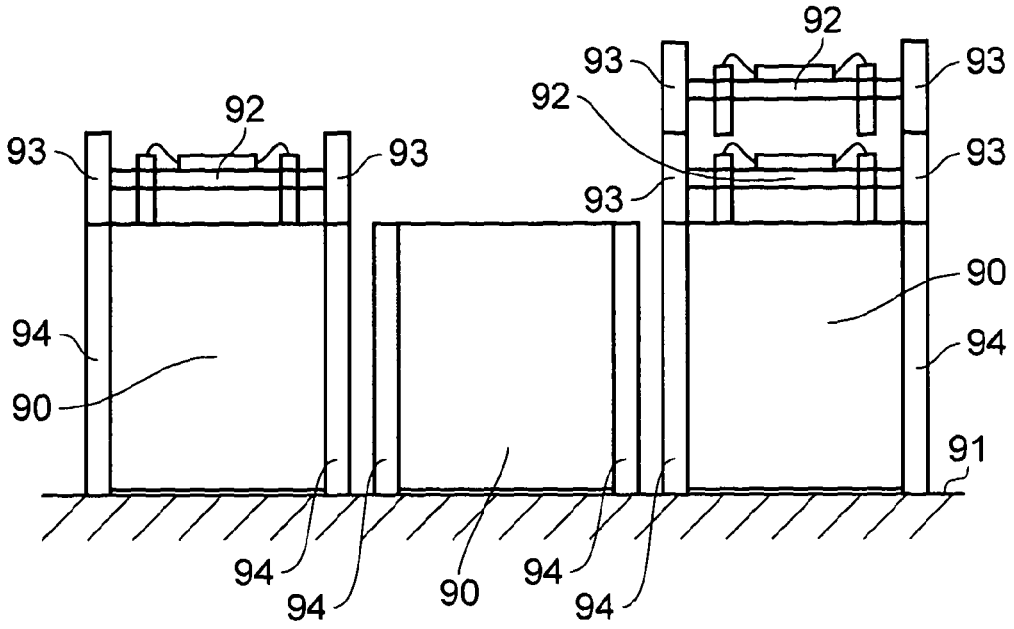
FIG. 28 shows how frames may be removed and stacked.

FIG. 28 shows how frames may be removed from the tanks by overhead cranes and stored on top of each other to permit access to the electrodes. If a single bar is used it will be feasible to lay the bar in a carrier system running alongside the tank for that purpose. If a frame is used the frame can be rotated and hung vertically at some convenient location alongside the tank. Frames can be lifted without rotation and stacked on an adjacent tank as illustrated in FIG. 28 in which 90 is a tank viewed end-on. The tanks stand on the ground 91. The power supply and pin assembly has legs 93 which rest on the tank sides in operation or which can be used to support a frame when standing on top of another one as shown.

Figure 30:
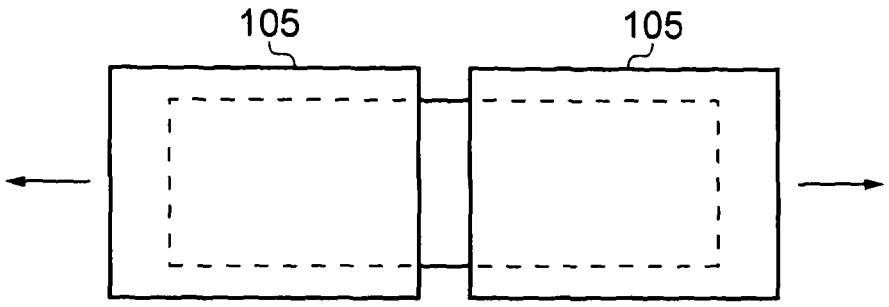
FIG. 30 shows a method of removing support bars and cover assemblies.

FIG. 30 shows an alternative arrangement for removing frame and cover assemblies when there is space available at the extremities of the tanks The power supplies, electrode-contacting arrangements and covers are removed in this example as two units 105 each covering half the tanks These units are lifted up to disengage from the electrodes and then moved longitudinally away from the centre of the tanks to allow an overhead crane access to the electrodes.

It is common practice in ER to cover the tanks with a fabric or other cover or a hood in order to, amongst other things, reduce heat loss. Where the frame arrangement is used, the area between support bars and frame bars can be filled in with a solid sheet material or a fabric sheet so that the performs the additional function of covering the tank. Power supplies for the electrodes can be carried on these frames. In the case of EW where there is gassing and potentially the production of acid mist, the hoods often used to control the emission of mist can also be incorporated in the frames.

Power supplies may be paralleled with one another by conducting support bars. However, if the pins are isolated from the support bar or the support bar is made of non-conducting material and the power supplies feed pins rather than the support bar, paralleling of the power supplies takes place on the electrodes. This may be advantageous for obtaining an even distribution of current in the electrodes.

Where anodes are suspended conventionally via lugs which rest on the sides of the tank, the cathode and power supply assembly can be supported on an orthogonal conducting cross member which rests on the upper surface of the anodes. Either the cathodes or the IEGs may be driven by this method. If the IEGs are driven the supporting cross member will need to have its two halves electrically isolated.

Figure 31:
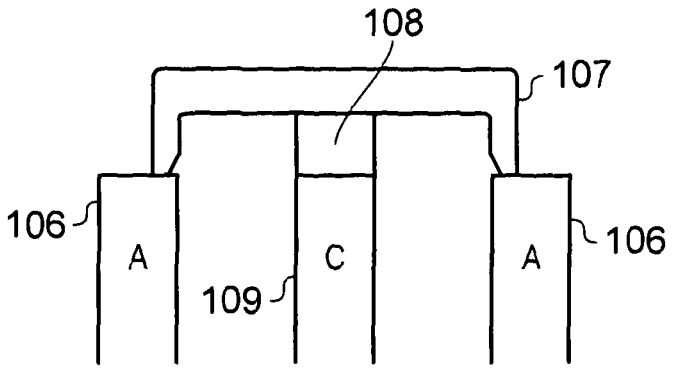
FIG. 31 is a side view of the upper ends of three electrodes, illustrating a method of using a cross member resting on anodes to support a cathode and regulator.

FIG. 31 is an edgewise view of the tank and the electrodes are viewed edge-on illustrating such an embodiment. Anodes 106 are suspended conventionally via lugs which rest on the sides of the tank. The cathode 109 and power supply assembly (comprising conducting cross member 107 and power supply 108) rests on the upper surface of the anodes. Either the cathodes or the IEGs may be driven by this method. If the IEGs are driven the supporting cross member 107 will need to have its two halves electrically isolated.

Whilst lugs on either side of the electrode plates are mentioned as typical means for supporting plates and getting current into and out of the plates, the power converters could be connected centrally to the plates or sandwiched between plates. It is a benefit of the system that the supply of current to the plates can be considered as an issue separate from that of suspending the plates. The problem of voltage drop in the regions of contact between the dc source and the plate can therefore be substantially reduced or eradicated.

The frame system described in the foregoing is used to supply dc current to the electrodes or electrode pairs. As an alternative, the power supplies can be carried by the electrodes. For example the converters can be carried on the cathode hanger bars and supply the cathodes relative to the anodes as described elsewhere in this description. In that case the frame/bar and pin system can be used to supply ac to the converters, the converters themselves not being on the bar or frame but on the cathodes. The bar/frame system may alternatively be used to supply dc to converters or regulators located on the cathodes.

Any frame arrangement may incorporate a central display panel to indicate the state of all the individual cathodes or IEGs in one place. This could for instance be a monitor display screen or a panel of LEDs. Such a display could be conveniently placed at the end of a tank next to a walkway.

The inventor has realised that where a cathode is fed by a power supply or regulator there is no control over how the current divides between the two sides of the cathode—that is to say between the IEGs. However, a cathode may optionally be composed of two metal sheets with an insulating layer between them.

Figure 32:
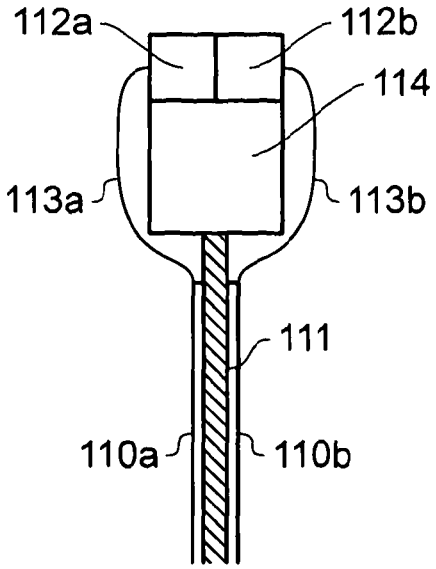
FIG. 32 is an edge view of a three-layer cathode plate in accordance with an embodiment of the invention.

FIG. 32 shows how a triple-layer cathode can be used to allow the current density on either side of the cathode to be controlled independently. The three layers may be bonded together or glued together to mechanically form a single sheet but with its two sides electrically isolated. Each side of this "sandwich" cathode can then be independently supplied by separate power supplies or regulators 112*a* and 112*b*. Wires 113 and 113*b* connect the converters or regulators 112*a* and 112*b* to respective metal plates 110*a* and 110*b*. The converters or regulators are supported by the hanger bar 114. Hence the voltage with respect to the adjacent anode can be controlled for each side of the cathode plate. There is likely to be a small voltage difference between the sides of the cathode and hence the metal sheets of the sandwich can be made slightly smaller in width and length so as to leave a margin of the insulating material around the periphery of the sandwich cathode on either side, thus giving a substantial tracking distance for any current which tries to pass from one side of the sandwich cathode to the other thereby putting a substantial resistance in the path of any such current flow.

Adjustable IEG Width and Longitudinal Systems

As previously stated, the feeding of IEGs with individual power supplies potentially gives anodes and cathodes a new mobility which can be used to make the gap between anodes and cathodes adjustable. Between croppings the gap can be adjusted to overcome the problem in traditional system in which the width of the IEG increases from one crop to the next as the anode thins. This would allow the minimum possible voltage to be employed to drive each cathode or IEG at the required current or current density thus saving energy. Also electrode spacing can become an adjustable variable in the process of ER or EW so as to optimise the process. Conventional practice is to use a fixed width and to locate the anodes and cathodes a distance apart which minimises the chance of interelectrode shorts. The use of local power supplies to power the cathodes or IEGs facilitates the use of an adjustable IEG width. For instance, if the power supply is carried on the cathode hanger bar and supplied by ac input power from a flexible cable or contact sliding on a catenary wire, the cathodes are free to move.

The anodes may also have a sliding contact for the return current path or have a cable connecting them to the power supply on the cathode. Alternatively all the electrodes could be supported on wheels and the ac current collected through these wheels with a flexible cable or strap providing the necessary path for dc current between the power supply mounted on the cathode and the anode. The means of moving the electrodes could be on the electrodes or external to the electrodes. For example the wheels described above could be motorised. The time between crops in a present technology tankhouse is typically seven days. Hence there is no need for high speed motion or rapid IEG width changes. These could be effected by very low power, low cost motors or actuators. Where multiple anodes and cathodes are employed in a tank, as in today's tank houses, the electrodes could shuffle slowly to adjust their positions with respect to each other at a speed which would be barely observable.

Figure 33:
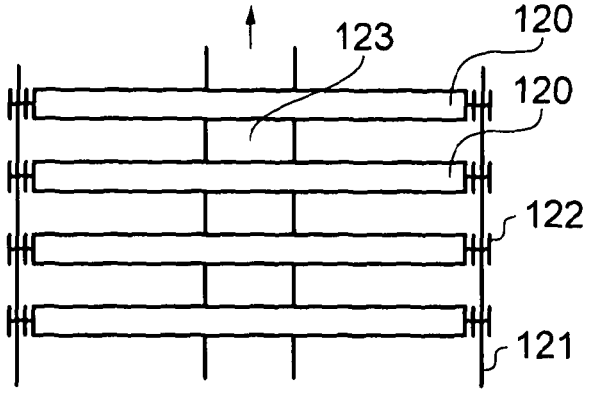
FIG. 33 is a top view of an electrode configuration illustrating a means of moving plates in a tank in production-line flow.

An additional or alternative possibility is shown in FIG. 33. A production-line approach can be adopted in which electrodes 120 progress along a single long tank 121, starting at one end and emerging at the other end when they are ready to be harvested. By this means labour cost in the tank house could be reduced substantially. If a short develops or threatens to develop between electrodes, the separation between electrodes can be dynamically adjusted to cure or prevent the short. Otherwise electrodes could be moved as closely together as possible to minimise energy loss due to electrolyte resistance. Rolling devices 122 permit the electrodes to move along with their power supplies 123.

Figure 34:
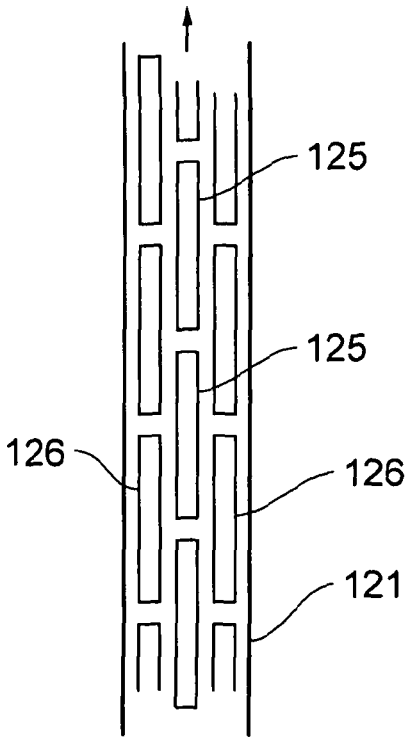
FIG. 34 shows a longitudinal arrangement for production line flow illustrated in FIG. 33.

Additionally or alternatively, mobile electrodes can be used in a new orientation as is illustrated in FIG. 34. The traditional orientation of the electrodes can be turned through 90 degrees as shown in FIG. 34. The cathodes may move in production line fashion between static anodes, entering at one end of the process and emerging from the tank at the other end ready for their metal deposit to be harvested. The anodes are static. This arrangement requires that some form of sliding contact would be required to complete the dc electrical circuit between the cathode and the anode electrodes.

Figure 35:
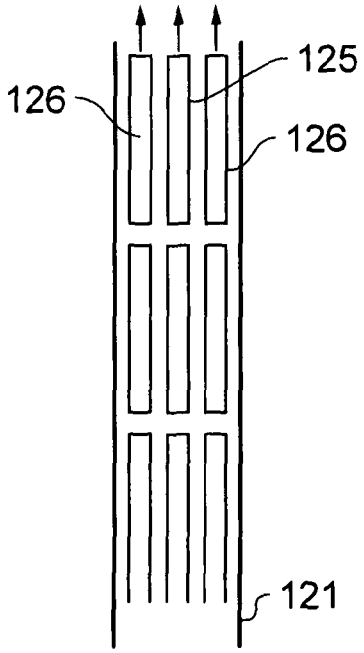
FIG. 35 shows an arrangement of longitudinal flow when anodes, cathodes and power supplies move together.
Figure 36:
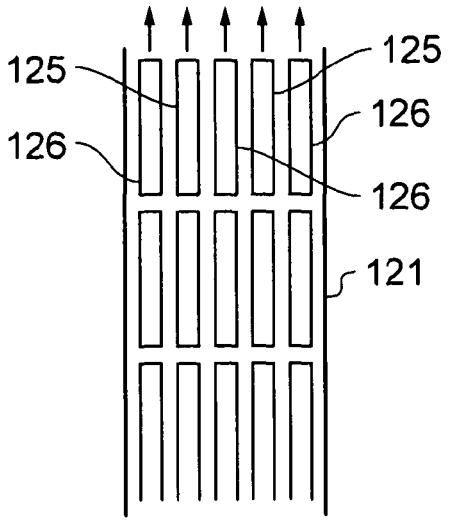
FIG. 36 shows a modification to the arrangement shown in FIG. 35.

Additionally or alternatively, a longitudinally oriented production system may be used as is illustrated in FIG. 35. Cathodes 125, anodes 126 and power supplies all travel together along the production line with either IEGs being fed by the power supplies or with cathodes being fed by the power supplies. The ac or dc power for the power supplies is collected from an overhead catenary with either both the parts of this supply being collected from catenaries or one part only being collected with the other part being though the rail system carrying the electrodes. FIG. 36 shows how a multiplicity of cathode and anode lines may progress along a production line as described in FIG. 35 permitting both sides of anodes to be used.

Alternatively, and to remove the need for a sliding contacts which carry IEG or cathode current, anodes and power supplies can all travel together along the production line with either IEGs being fed by the power supplies or cathodes being fed by the power supplies. The ac or dc power for the power supplies is collected from an overhead catenary with either both the parts of this supply being collected from catenaries or one part only being collected with the other part being though the rail system carrying the electrodes. The width of the IEGs on either side of the cathode can be varied by moving the rails carrying the anodes closer to or further away from the cathode support rail. This can be carried out dynamically as the product passes down the line. Potential shorts can be knocked off by inserting fixed insulating rods in the gap between the cathodes and anodes so that as the cathodes pass by the rod knocks off high spots. If it is wished to increase the density of production, multiple rows of cathodes and anodes can be used when an anode-cathode array travels along the production line rather that one cathode and two anodes.

Although the discussion thus far has been in respect of controlling the current supplied to the electrodes, and preferably the current across the inter-electrode gap in a cell, the inventor has realised that some electrowinning and electrorefining operators may initially merely wish to measure the electrode current.

In a variation, current measuring means may be associated with at least some of, and preferably every, cathode and/or anode. In a preferred arrangement current measuring equipment is associated with every electrode.

Where, as is the case shown in FIGS. 7*b* and 7*c* the electrode has projections e.g. lugs 11, which contact with bus-bars 12, then the power supplies 9 and 13 which are electrically interposed between the lug 11 and the bus bar 13 can be replaced by current measuring transducers. Where the electrode has two lugs, a measurement device needs to be associated with each lug.

The current measuring devices may communicate back to a central processor. Such communication could be wireless or wired. Wired communication can be via respective data wires, a common databus or even by modulating data into the bus-bars themselves.

Current measurement of DC currents may be performed by measuring the voltage drop across a known resistance. Alternatively, the current may be constrained to follow a current flow path, and the magnetic field around the path can be measured. Suitable technologies are available in the form of a hall effect devices and magneto-resistive sensors. Commercially available sensors often include bias and/or flipping coils so such sensors working alone or in combination can compensate for external magnetic fields, such as those from the bus bar.

Similarly, because the lugs 11 represent short but well defined conductive paths, then it is possible to use a magnetic field based current transducer to measure the current in the lugs 11.

Similarly, where electrodes of the configuration shown in FIGS. 21 and 22 are used the regulators 65 can be replaced by current sensors, with associated signal processing and transmission circuits.

Advantageously the current measuring transducers also include voltage measuring circuits, either referenced to a neighbouring electrode or to a reference potential (such as ground) so the voltages across an inter-electrode gap can be directly measured or calculated.

Thus it becomes possible to measure the current-voltage characteristic between adjacent electrodes, and consequently to be able to detect the formation of metal spikes, to understand electrode performance, to link crop history to current flow, and so on.

Similarly, where the electrodes are supplied via short (or long) wires, a current measuring circuit can be placed around each wire, and the current flow to each cell measured, even though this may require summing several measurements when an electrode has multiple current feeds.

Such measurements may also be displayed on audio-visual reporting units. Thus a warning can be given when current to an electrode moves outside of a predetermined range of values.

Even just measuring the current may bring some production benefits as comparisons of current flow between neighbouring electrodes may point to electrode misalignment which may be remedied by slightly moving the electrode.

It should be noted that local processing and data storage may be included with each power supply or current measuring device. This may be appropriate where adding communications to a central computer may be difficult or costly. In such an arrangement data can be stored locally and periodically collected, by contact or contactless means, for analysis.

In summary, the present invention provides several advantages. The cathode and anode electrodes need not be of the same size. If it is convenient, an electrode of one type (anode or cathode) could be faced with (i.e. incorporated in a cell) two (or more) electrodes of the other type (cathode or anode) with each of the half-sized (or reduced-size) plates being supplied by a converter of half (or less) the capacity that would be required if both (all) plates were whole size. This arrangement could be particularly useful when plates are supplied from lugs or terminals on each side (when the plates are hung vertically in a tank). Each side (half-size plate) can be supplied from its own converter. An insulating bar across the tank would supply mechanical support for the two half-size sheets.

When both ER and EW are considered, the range of output voltage required from the power supplies is considerable. At the high end, the EW of zinc can require a voltage of the order of 3.5 Volts. At the low end, the typical net over-potential in the ER of copper is typically just over 0.2V. Traditional expectations are that with the effect of voltage drop in the electrolyte resistance, contact resistances and conductor resistance, the required voltage can be of the order of 0.3 V. The invention seeks to drive down this voltage in order to save energy (since the power consumed by a cell is equal to the product of the current passing through the cell and the voltage drop across the cell). The invention permits anodes and cathodes to be located closer together than prejudice of conventional industrial practice teaches thereby reducing the resistance of the electrolyte-filled interelectrode gap. Furthermore the power supplies which in the invention feed IEGs (or individual cathodes if required) can be located very close to the IEGs (or electrodes) thereby avoiding the resistive drop encountered when cables of more than a few centimeters are used to connect the power supplies to the electrodes. In the invention, the power supplies may optionally be located on the electrodes themselves (typically the cathodes) avoiding all use of cable. When the IEG is driven, the power supplies maybe constructed to be of similar thickness to the IEG and therefore capable of being located on the lip of the tank close to the electrodes. Hence either no cable is required or only a few centimeters of cable are required to make connection between the power supplies and the electrodes. The outcome of the application of these techniques for voltage drop reduction is that the power supplies may have to provide a voltage in normal operation well below the normally accepted operating voltage. In the ER of copper over-potentials cancel so that there is no theoretical limit to how low the voltage between anode and cathode may become. Furthermore, and outside of normal operation, a spike of metal may grow on the cathode either creating a short between the anode and cathode or threatening to do so. This situation may be managed in a number of ways—for instance the power supply may reduce its output voltage to limit the current flowing through the metal spike or short circuit. In which case at that time a very low power supply output voltage will be required.

The invention claimed is:

1. An apparatus for use in electrorefining or electrowinning of metals, comprising:

a plurality of anodes and a plurality of cathodes in an interleaved configuration in a single tank, wherein each anode and cathode pair forms a cell;

a plurality of power supplies, each cell associated with one or more respective power supplies; and the power supplies are each arranged to independently control a direct current to one of the anodes or cathodes in the cells to a predetermined value, and wherein at least one of the cathodes is electrically connected to at least two of the power supplies.

2. The apparatus as claimed in claim 1, in which each power supply is associated with a controller arranged to control the direct current such that a current density in the cells is at a predetermined value.

3. The apparatus as claimed in claim 1, in which the direct current is controlled as a function of at least one of cathode-anode separation within a cell, cathode-anode voltage across a cell, electrode size, electrode configuration, electrode flatness, electrode quality, electrode impedance, temperature, electrolyte concentration, and an evolution over time of a current to voltage characteristic of the cell.

4. The apparatus as claimed in claim 2, in which each controller is associated with or part of its associated power supply.

5. The apparatus as claimed in claim 2, in which each power supply includes a current measuring device and an associated controller controls the operation of the power supply in response to current measurements made by the current measuring device.

6. The apparatus as claimed in claim 2, in which as least some of the power supplies include a communication device for exchanging data with a computer, and one or more of the controllers or the computer is responsive to measurements of current in and voltage across a cell to determine if a bump or spike is forming in the cell.

7. The apparatus as claimed in claim 1, in which every Nth anode or cathode is held at a predetermined voltage or ground.

8. The apparatus as claimed in claim 1, further including at least one step down transformer to reduce a supply voltage to an intermediate voltage for input to the power supplies in which the transformer is separable into two parts, which when brought together form an inductive power coupling.

9. The apparatus as claimed in claim 1, in which each power supply includes a data processor or other device for inhibiting current flow when a voltage-current relationship in the associated cell is indicative of a short circuit having occurred or being likely to occur within a predetermined time frame.

10. The apparatus as claimed in claim 2, in which more than one power supply is used per anode or per cathode, and in which where a plurality of power supplies are connected to a common anode or cathode, their respective controllers cooperate with each other to share control and predetermined current information.

11. The apparatus as claimed in claim 1, in which an anode or cathode is split into sub electrodes, each sub electrode with a respective power supply or with respective current control.

12. The apparatus as claimed in claim 1, in which at least some of the cathodes and/or some of the anodes are suspended from a support extending over an electrolyte within an electrolyte tank and are insulated from the support, in which the power supplies comprise transistors driven at a switching frequency in association with resonant or quasi resonant circuits and wherein the switching frequency is greater than 20 kHz.

13. The apparatus as claimed in claim 1, in which an anode-cathode gap is adjustable and is controlled in response to a current density in the cell or a voltage across the cell.

14. The apparatus as claimed in claim 1, further including connectors and hanger bars, wherein at least some of the connectors between the power supplies, hanger bars, the anodes and the cathodes comprise contacts which press against a cooperating conductive surface.

15. The apparatus as claimed in claim 14, in which the contacts are pins.

16. The apparatus as claimed in claim 14, in which the contacts are spring loaded or resilient.

17. The apparatus as claimed in claim 1, wherein at least one of the anodes is electrically connected to at least two of the power supplies.

18. The apparatus as claimed in claim 1, wherein each power supply is adjacent an anode or a cathode that it is electrically associated therewith.

19. The apparatus as claimed in claim 1, wherein each power supply is integrated with or touching a hanger bar that supports an anode or a cathode.

20. An apparatus for use in electrorefining or electrowinning of metals, comprising:

a plurality of anodes and a plurality of cathodes in an interleaved configuration in a single tank, wherein each anode and cathode pair forms a cell;

a plurality of power supplies, each cell associated with one or more respective power supplies; and the power supplies are arranged to control a direct current in the cells to a predetermined value, wherein each cell is not in series current flow communication with its neighbor, and wherein at least one of the cathodes is electrically connected to at least two of the power supplies.

* * * * *